US009079202B2

(12) United States Patent
Walker et al.

(10) Patent No.: US 9,079,202 B2
(45) Date of Patent: Jul. 14, 2015

(54) ROTARY VARIABLE ARC NOZZLE

(75) Inventors: Samuel C. Walker, Green Valley, AZ (US); John Austin Brennan, Tuscon, AZ (US); Alberto Carrillo Maloof, Tijuana (MX)

(73) Assignee: Rain Bird Corporation, Azusa, CA (US)

( * ) Notice: Subject to any disclaimer, the term of this patent is extended or adjusted under 35 U.S.C. 154(b) by 473 days.

(21) Appl. No.: 13/495,402

(22) Filed: Jun. 13, 2012

(65) Prior Publication Data

US 2013/0334340 A1 Dec. 19, 2013

(51) Int. Cl.

| | |
|---|---|
| ***B05B 3/04*** | (2006.01) |
| ***B05B 1/30*** | (2006.01) |
| ***B05B 3/16*** | (2006.01) |
| ***B05B 3/00*** | (2006.01) |
| ***B05B 3/02*** | (2006.01) |

(52) U.S. Cl.

CPC ..... *B05B 1/304* (2013.01); *B05B 1/3073* (2013.01); *B05B 1/3086* (2013.01); *B05B 3/003* (2013.01); *B05B 3/021* (2013.01); *B05B 3/04* (2013.01); *B05B 3/0486* (2013.01); *B05B 3/165* (2013.01)

(58) Field of Classification Search

CPC ..... B05B 3/0486; B05B 3/02; B05B 3/165; B05B 3/0422; B05B 3/003; B05B 3/04; B05B 1/3073; B05B 1/12; B05B 1/3086

USPC ..... 239/222.17, 225.1, 233, 237, 252, 263, 239/451, 456, 459, 460

See application file for complete search history.

(56) References Cited

U.S. PATENT DOCUMENTS

| | | | |
|---|---|---|---|
| 458,607 | A | 9/1891 | Weiss |
| 1,523,609 | A | 1/1922 | Roach |
| 1,432,386 | A | 10/1922 | Curney |
| 2,075,589 | A | 4/1933 | Munz |
| 2,125,863 | A | 4/1933 | Munz |
| 2,125,978 | A | 8/1938 | Arbogast |
| 2,128,552 | A | 8/1938 | Arbogast |
| 2,325,280 | A | 8/1938 | Rader |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

USPTO Office Action in U.S. Appl. No. 13/300,946, Mailed Jun. 7, 2012.

(Continued)

*Primary Examiner* — Steven J Ganey
(74) *Attorney, Agent, or Firm* — Fitch, Even, Tabin & Flannery, LLP

(57) ABSTRACT

A variable arc sprinkler head or nozzle may be set to numerous positions to adjust the arcuate span of the sprinkler. The nozzle may include an arc adjustment valve having two portions that helically engage each other to define an opening that may be adjusted at the top of the sprinkler to a desired arcuate length. The arcuate length may be adjusted by pressing down and rotating a deflector to directly actuate the valve. The nozzle may also include a radius reduction valve that may be adjusted by actuation of an outer wall of the nozzle. Rotation of the outer wall causes a flow control member to move axially to or away from an inlet.

18 Claims, 10 Drawing Sheets

(56) References Cited

U.S. PATENT DOCUMENTS

| | | | | |
|---|---|---|---|---|
| 2,130,810 | A | | 9/1938 | Munz |
| 2,348,776 | A | | 4/1941 | Bentley |
| 2,634,163 | A | | 2/1948 | Double |
| 2,723,879 | A | | 11/1955 | Martin |
| 2,785,013 | A | | 3/1957 | Stearns |
| 2,875,783 | A | | 3/1957 | Schippers |
| 2,935,266 | A | | 6/1958 | Coleondro et al. |
| 2,914,257 | A | | 1/1959 | Wiant |
| 2,990,123 | A | | 6/1961 | Hyde |
| 2,990,128 | A | | 6/1961 | Hyde |
| 3,029,030 | A | | 4/1962 | Dey |
| 3,109,591 | A | | 11/1963 | Moen |
| 3,239,149 | A | | 3/1966 | Moen |
| 3,380,659 | A | | 4/1968 | Seablom |
| 3,940,066 | A | | 2/1976 | Hunter |
| 3,948,285 | A | | 4/1976 | Flynn |
| 3,955,764 | A | | 5/1976 | Phaup |
| 4,026,471 | A | | 5/1977 | Hunter |
| 4,119,275 | A | | 10/1978 | Hunter |
| 4,131,234 | A | | 12/1978 | Pescetto |
| 4,189,099 | A | | 2/1980 | Bruninga |
| 4,198,000 | A | | 4/1980 | Hunter |
| 4,253,608 | A | | 3/1981 | Hunter |
| 4,272,024 | A | | 6/1981 | Kah |
| 4,353,506 | A | | 10/1982 | Hayes |
| 4,353,507 | A | | 10/1982 | Kah |
| 4,398,666 | A | | 8/1983 | Hunter |
| 4,417,691 | A | | 11/1983 | Lockwood |
| 4,456,181 | A | | 6/1984 | Burnham |
| 4,471,908 | A | | 9/1984 | Hunter |
| 4,479,611 | A | | 10/1984 | Galvis |
| 4,501,391 | A | | 2/1985 | Hunter |
| 4,566,632 | A | | 1/1986 | Sesser |
| 4,568,024 | A | | 2/1986 | Hunter |
| 4,579,284 | A | | 4/1986 | Arnold |
| 4,579,285 | A | | 4/1986 | Hunter |
| 4,618,100 | A | | 10/1986 | White |
| 4,624,412 | A | | 11/1986 | Hunter |
| 4,625,917 | A | | 12/1986 | Torney |
| RE32,386 | E | | 3/1987 | Hunter |
| 4,660,766 | A | | 4/1987 | Nelson et al. |
| 4,669,663 | A | | 6/1987 | Meyer |
| 4,676,438 | A | | 6/1987 | Sesser |
| 4,681,260 | A | | 7/1987 | Cochran |
| 4,681,263 | A | | 7/1987 | Cockman |
| 4,699,321 | A | | 10/1987 | Bivens et al. |
| 4,708,291 | A | | 11/1987 | Grundy |
| 4,718,605 | A | | 1/1988 | Hunter |
| 4,720,045 | A | | 1/1988 | Meyer |
| 4,739,934 | A | | 4/1988 | Gewelber |
| D296,464 | S | | 6/1988 | Marmol et al. |
| 4,752,031 | A | | 6/1988 | Merrick |
| 4,763,838 | A | | 8/1988 | Holcomb |
| 4,784,325 | A | | 11/1988 | Walker |
| 4,796,809 | A | | 1/1989 | Hunter |
| 4,796,811 | A | | 1/1989 | Davisson |
| 4,815,662 | A | | 3/1989 | Hunter |
| 4,834,289 | A | | 5/1989 | Hunter |
| 4,836,449 | A | | 6/1989 | Hunter |
| 4,836,450 | A | | 6/1989 | Hunter |
| 4,840,312 | A | | 6/1989 | Tyler |
| 4,842,201 | A | | 6/1989 | Hunter |
| 4,867,378 | A | | 9/1989 | Kah, Jr. |
| 4,898,332 | A | | 2/1990 | Hunter et al. |
| 4,901,924 | A | | 2/1990 | Kah, Jr. |
| 4,932,590 | A | | 6/1990 | Hunter |
| 4,944,456 | A | | 7/1990 | Zakai |
| 4,948,052 | A | | 8/1990 | Hunter |
| 4,955,542 | A | | 9/1990 | Kah, Jr. |
| 4,961,534 | A | | 10/1990 | Tyler et al. |
| 4,967,961 | A | | 11/1990 | Hunter |
| 4,971,250 | A | | 11/1990 | Hunter |
| D312,865 | S | | 12/1990 | Davisson |
| 4,986,474 | A | | 1/1991 | Schisler et al. |
| 5,031,840 | A | | 7/1991 | Grundy et al. |
| 5,050,800 | A | | 9/1991 | Lamar |
| 5,052,621 | A | | 10/1991 | Katzer et al. |
| 5,058,806 | A | | 10/1991 | Rupar |
| 5,078,321 | A | | 1/1992 | Davis |
| 5,083,709 | A | | 1/1992 | Iwanowski |
| RE33,823 | E | | 2/1992 | Nelson et al. |
| 5,086,977 | A | | 2/1992 | Kah, Jr. |
| 5,090,619 | A | | 2/1992 | Barthold |
| 5,098,021 | A | | 3/1992 | Kah, Jr. |
| 5,104,045 | A | | 4/1992 | Kah, Jr. |
| 5,123,597 | A | | 6/1992 | Bendall |
| 5,141,024 | A | | 8/1992 | Hicks |
| 5,148,990 | A | | 9/1992 | Kah, Jr. |
| 5,148,991 | A | | 9/1992 | Kah, Jr. |
| 5,152,458 | A | | 10/1992 | Curtis |
| 5,158,232 | A | | 10/1992 | Tyler et al. |
| 5,174,501 | A | | 12/1992 | Hadar |
| 5,199,646 | A | | 4/1993 | Kah, Jr. |
| 5,205,491 | A | | 4/1993 | Hadar |
| 5,224,653 | A | | 7/1993 | Nelson et al. |
| 5,226,599 | A | | 7/1993 | Lindermeir et al. |
| 5,226,602 | A | | 7/1993 | Cochran et al. |
| 5,234,169 | A | | 8/1993 | McKenzie |
| 5,240,182 | A | | 8/1993 | Lemme |
| 5,240,184 | A | | 8/1993 | Lawson |
| 5,267,689 | A | | 12/1993 | Forer |
| 5,288,022 | A | * | 2/1994 | Sesser ..... 239/222.17 |
| 5,299,742 | A | | 4/1994 | Han |
| 5,322,223 | A | | 6/1994 | Hadar |
| 5,335,857 | A | | 8/1994 | Hagon |
| 5,360,167 | A | | 11/1994 | Grundy et al. |
| 5,370,311 | A | | 12/1994 | Chen |
| 5,372,307 | A | * | 12/1994 | Sesser ..... 239/222.17 |
| 5,375,768 | A | | 12/1994 | Clark |
| 5,398,872 | A | | 3/1995 | Joubran |
| 5,417,370 | A | | 5/1995 | Kah, Jr. |
| 5,423,486 | A | | 6/1995 | Hunter |
| 5,435,490 | A | | 7/1995 | Machut |
| 5,439,174 | A | | 8/1995 | Sweet |
| RE35,037 | E | | 9/1995 | Kah et al. |
| 5,456,411 | A | | 10/1995 | Scott et al. |
| 5,503,139 | A | | 4/1996 | McMahon |
| 5,526,982 | A | | 6/1996 | McKenzie |
| 5,544,814 | A | | 8/1996 | Spenser |
| 5,556,036 | A | | 9/1996 | Chase |
| 5,588,594 | A | | 12/1996 | Kah, Jr. |
| 5,588,595 | A | | 12/1996 | Sweet et al. |
| 5,598,977 | A | | 2/1997 | Lemme |
| 5,611,488 | A | | 3/1997 | Frolich |
| 5,620,141 | A | | 4/1997 | Chiang |
| 5,640,983 | A | | 6/1997 | Sherman |
| 5,642,861 | A | | 7/1997 | Ogi et al. |
| 5,653,390 | A | | 8/1997 | Kah, Jr. |
| 5,662,545 | A | | 9/1997 | Zimmerman et al. |
| 5,671,885 | A | | 9/1997 | Davisson |
| 5,671,886 | A | | 9/1997 | Sesser |
| 5,676,315 | A | | 10/1997 | Han |
| D388,502 | S | | 12/1997 | Kah, III |
| 5,695,123 | A | | 12/1997 | Le |
| 5,699,962 | A | | 12/1997 | Scott et al. |
| 5,711,486 | A | | 1/1998 | Clark et al. |
| 5,718,381 | A | | 2/1998 | Katzer et al. |
| 5,720,435 | A | | 2/1998 | Hunter |
| 5,722,593 | A | | 3/1998 | McKenzie |
| 5,758,827 | A | | 6/1998 | Van Le et al. |
| 5,762,270 | A | | 6/1998 | Kearby et al. |
| 5,765,757 | A | | 6/1998 | Bendall |
| 5,765,760 | A | | 6/1998 | Kuo |
| 5,769,322 | A | | 6/1998 | Smith |
| 5,785,248 | A | | 7/1998 | Staylor et al. |
| 5,820,029 | A | | 10/1998 | Marans |
| 5,823,439 | A | | 10/1998 | Hunter et al. |
| 5,823,440 | A | | 10/1998 | Clark |
| 5,826,797 | A | | 10/1998 | Kah, III |
| 5,845,849 | A | | 12/1998 | Mitzlaff |
| 5,875,969 | A | | 3/1999 | Grundy |
| 5,918,812 | A | | 7/1999 | Beutler |
| 5,927,607 | A | | 7/1999 | Scott |
| 5,971,297 | A | | 10/1999 | Sesser |

(56) References Cited

U.S. PATENT DOCUMENTS

| | | | |
|---|---|---|---|
| 5,988,523 | A | 11/1999 | Scott |
| 5,992,760 | A | 11/1999 | Kearby et al. |
| 6,007,001 | A | 12/1999 | Hilton |
| 6,019,295 | A | 2/2000 | McKenzie |
| 6,029,907 | A | 2/2000 | McKenzie |
| 6,042,021 | A | 3/2000 | Clark |
| 6,050,502 | A | 4/2000 | Clark |
| 6,076,744 | A | 6/2000 | OBrien |
| 6,076,747 | A | 6/2000 | Ming-Yuan |
| 6,085,995 | A | 7/2000 | Kah, Jr. et al. |
| 6,102,308 | A | 8/2000 | Steingrass |
| 6,109,545 | A | 8/2000 | Kah, Jr. |
| 6,138,924 | A | 10/2000 | Hunter et al. |
| 6,145,758 | A | 11/2000 | Ogi et al. |
| 6,155,493 | A | 12/2000 | Kearby |
| 6,158,675 | A | 12/2000 | Ogi |
| 6,182,909 | B1 | 2/2001 | Kah, Jr. et al. |
| 6,186,413 | B1 | 2/2001 | Lawson |
| 6,223,999 | B1 | 5/2001 | Lemelshtrich |
| 6,227,455 | B1 | 5/2001 | Scott et al. |
| 6,230,988 | B1 | 5/2001 | Chao |
| 6,230,989 | B1 | 5/2001 | Haverstraw |
| 6,237,862 | B1 | 5/2001 | Kah, III et al. |
| 6,241,158 | B1 | 6/2001 | Clark et al. |
| 6,244,521 | B1 | 6/2001 | Sesser |
| 6,264,117 | B1 | 7/2001 | Roman |
| 6,286,767 | B1 | 9/2001 | Hui-Chen |
| 6,332,581 | B1 | 12/2001 | Chin et al. |
| 6,336,597 | B1 | 1/2002 | Kah, Jr. |
| 6,341,733 | B1 | 1/2002 | Sweet |
| 6,345,541 | B1 | 2/2002 | Hendey |
| 6,367,708 | B1 | 4/2002 | Olson |
| D458,342 | S | 6/2002 | Johnson |
| 6,443,372 | B1 | 9/2002 | Hsu |
| 6,454,186 | B2 | 9/2002 | Haverstraw et al. |
| 6,457,656 | B1 | 10/2002 | Scott |
| 6,464,151 | B1 | 10/2002 | Cordua |
| 6,478,237 | B2 | 11/2002 | Kearby |
| 6,488,218 | B1 | 12/2002 | Townsend et al. |
| 6,491,235 | B1 | 12/2002 | Scott et al. |
| 6,494,384 | B1 | 12/2002 | Meyer |
| 6,499,672 | B1 | 12/2002 | Sesser |
| 6,530,531 | B2 | 3/2003 | Butler |
| 6,601,781 | B2 | 8/2003 | Kah, III et al. |
| 6,607,147 | B2 | 8/2003 | Schneider et al. |
| 6,622,940 | B2 | 9/2003 | Huang |
| 6,637,672 | B2 | 10/2003 | Cordua |
| 6,651,904 | B2 | 11/2003 | Roman |
| 6,651,905 | B2 | 11/2003 | Sesser et al. |
| 6,688,539 | B2 | 2/2004 | Vander Griend |
| 6,695,223 | B2 | 2/2004 | Beutler et al. |
| 6,715,699 | B1 | 4/2004 | Greenberg |
| 6,719,218 | B2 | 4/2004 | Cool |
| 6,732,952 | B2 | 5/2004 | Kah, Jr. |
| 6,736,332 | B2 | 5/2004 | Sesser et al. |
| 6,736,336 | B2 | 5/2004 | Wong |
| 6,769,633 | B1 | 8/2004 | Huang |
| 6,814,304 | B2 | 11/2004 | Onofrio |
| 6,814,305 | B2 | 11/2004 | Townsend |
| 6,817,543 | B2 | 11/2004 | Clark |
| 6,820,825 | B1 | 11/2004 | Wang |
| 6,827,291 | B2 | 12/2004 | Townsend |
| 6,834,816 | B2 | 12/2004 | Kah, Jr. |
| 6,840,460 | B2 | 1/2005 | Clark |
| 6,848,632 | B2 | 2/2005 | Clark |
| 6,854,664 | B2 | 2/2005 | Smith |
| 6,869,026 | B2 | 3/2005 | McKenzie et al. |
| 6,871,795 | B2 | 3/2005 | Anuskiewicz |
| 6,880,768 | B2 | 4/2005 | Lau |
| 6,883,727 | B2 | 4/2005 | De Los Santos |
| 6,921,030 | B2 | 7/2005 | Renquist |
| 6,942,164 | B2 | 9/2005 | Walker |
| 6,945,471 | B2 | 9/2005 | McKenzie et al. |
| 6,957,782 | B2 | 10/2005 | Clark et al. |
| 6,997,393 | B1 | 2/2006 | Angold et al. |
| 7,017,831 | B2 | 3/2006 | Santiago et al. |
| 7,017,837 | B2 | 3/2006 | Taketomi |
| 7,028,920 | B2 | 4/2006 | Hekman et al. |
| 7,028,927 | B2 | 4/2006 | Mermet |
| 7,032,836 | B2 | 4/2006 | Sesser et al. |
| 7,032,844 | B2 | 4/2006 | Cordua |
| 7,040,553 | B2 | 5/2006 | Clark |
| 7,044,403 | B2 | 5/2006 | Kah, III et al. |
| 7,070,122 | B2 | 7/2006 | Burcham |
| 7,090,146 | B1 | 8/2006 | Ericksen et al. |
| 7,100,842 | B2 | 9/2006 | Meyer et al. |
| 7,104,472 | B2 | 9/2006 | Renquist |
| 7,111,795 | B2 | 9/2006 | Thong |
| 7,143,957 | B2 | 12/2006 | Nelson |
| 7,143,962 | B2 | 12/2006 | Kah, Jr. |
| 7,152,814 | B1 | 12/2006 | Schapper et al. |
| 7,156,322 | B1 | 1/2007 | Heitzman |
| 7,159,795 | B2 | 1/2007 | Sesser et al. |
| 7,168,634 | B2 | 1/2007 | Onofrio |
| 7,232,081 | B2 | 6/2007 | Kah, Jr. et al. |
| 7,234,651 | B2 | 6/2007 | Mousavi et al. |
| 7,240,860 | B2 | 7/2007 | Griend |
| 7,287,711 | B2 | 10/2007 | Crooks |
| 7,293,721 | B2 | 11/2007 | Roberts |
| 7,303,147 | B1 | 12/2007 | Danner et al. |
| 7,303,153 | B2 | 12/2007 | Han |
| 7,322,533 | B2 | 1/2008 | Grizzle |
| 7,337,988 | B2 | 3/2008 | McCormick |
| RE40,440 | E | 7/2008 | Sesser |
| 7,392,956 | B2 | 7/2008 | McKenzie |
| 7,429,005 | B2 | 9/2008 | Schapper |
| 7,478,526 | B2 | 1/2009 | McAfee |
| 7,533,833 | B2 | 5/2009 | Wang |
| 7,581,687 | B2 | 9/2009 | Feith |
| 7,584,906 | B2 | 9/2009 | Lev |
| 7,597,273 | B2 | 10/2009 | McAfee |
| 7,607,588 | B2 | 10/2009 | Nobili |
| 7,611,077 | B2 | 11/2009 | Sesser et al. |
| 7,621,467 | B1 | 11/2009 | Garcia |
| 7,654,474 | B2 | 2/2010 | Cordua |
| 7,686,235 | B2 | 3/2010 | Roberts |
| 7,686,236 | B2 | 3/2010 | Alexander |
| 7,703,706 | B2 | 4/2010 | Walker |
| D615,152 | S | 5/2010 | Kah et al. |
| 7,766,259 | B2 | 8/2010 | Feith |
| D628,272 | S | 11/2010 | Kah et al. |
| 7,828,229 | B2 | 11/2010 | Kah |
| 7,850,094 | B2 | 12/2010 | Richmond et al. |
| 7,861,948 | B1 | 1/2011 | Crooks |
| D636,459 | S | 4/2011 | Kah et al. |
| 7,926,746 | B2 | 4/2011 | Melton |
| 7,971,804 | B2 | 7/2011 | Roberts |
| RE42,596 | E | 8/2011 | Sesser |
| 8,006,919 | B2 | 8/2011 | Renquist et al. |
| 8,047,456 | B2 | 11/2011 | Kah et al. |
| 8,056,829 | B2 | 11/2011 | Gregory |
| 8,074,897 | B2 | 12/2011 | Hunnicutt et al. |
| 8,205,811 | B2 | 6/2012 | Cordua |
| 8,272,583 | B2 | 9/2012 | Hunnicutt et al. |
| 2001/0023901 | A1 | 9/2001 | Haverstraw et al. |
| 2002/0070289 | A1 | 6/2002 | Hsu |
| 2002/0130202 | A1 | 9/2002 | Kah, Jr. et al. |
| 2002/0153434 | A1 | 10/2002 | Cordua |
| 2003/0006304 | A1 | 1/2003 | Cool |
| 2003/0015606 | A1 | 1/2003 | Cordua |
| 2003/0042327 | A1 | 3/2003 | Beutler |
| 2003/0071140 | A1 | 4/2003 | Roman |
| 2003/0075620 | A1 | 4/2003 | Kah, Jr. |
| 2004/0108391 | A1 | 6/2004 | Onofrio |
| 2005/0006501 | A1 | 1/2005 | Englefield |
| 2005/0161534 | A1 | 7/2005 | Kah |
| 2005/0194464 | A1 | 9/2005 | Bruninga |
| 2005/0194479 | A1 | 9/2005 | Curtis |
| 2006/0038046 | A1 | 2/2006 | Curtis |
| 2006/0086832 | A1 | 4/2006 | Roberts |
| 2006/0086833 | A1 | 4/2006 | Roberts |
| 2006/0108445 | A1 | 5/2006 | Pinch |
| 2006/0144968 | A1 | 7/2006 | Lev |
| 2006/0237198 | A1 | 10/2006 | Crampton |

(56) References Cited

U.S. PATENT DOCUMENTS

| | | | |
|---|---|---|---|
| 2006/0273202 | A1 | 12/2006 | Su |
| 2006/0281375 | A1 | 12/2006 | Jordan |
| 2007/0012800 | A1 | 1/2007 | McAfee |
| 2007/0034711 | A1 | 2/2007 | Kah, Jr. |
| 2007/0034712 | A1 | 2/2007 | Kah, Jr. |
| 2007/0119975 | A1 | 5/2007 | Hunnicutt |
| 2007/0181711 | A1 | 8/2007 | Sesser et al. |
| 2007/0235565 | A1 | 10/2007 | Kah, Jr. et al. |
| 2007/0246567 | A1 | 10/2007 | Roberts |
| 2008/0169363 | A1 | 7/2008 | Walker |
| 2008/0217427 | A1 | 9/2008 | Wang |
| 2008/0257982 | A1 | 10/2008 | Kah |
| 2008/0276391 | A1 | 11/2008 | Jung |
| 2008/0277499 | A1 | 11/2008 | McAfee |
| 2009/0008484 | A1 | 1/2009 | Feith |
| 2009/0014559 | A1 | 1/2009 | Marino |
| 2009/0072048 | A1 | 3/2009 | Renquist |
| 2009/0078788 | A1 | 3/2009 | Holmes |
| 2009/0108099 | A1 | 4/2009 | Porter |
| 2009/0140076 | A1 | 6/2009 | Cordua |
| 2009/0173803 | A1 | 7/2009 | Kah, Jr. et al. |
| 2009/0173904 | A1 | 7/2009 | Roberts |
| 2009/0188988 | A1 | 7/2009 | Walker |
| 2010/0090024 | A1 | 4/2010 | Hunnicutt |
| 2010/0108787 | A1 | 5/2010 | Walker |
| 2010/0176217 | A1 | 7/2010 | Richmond |
| 2010/0257670 | A1 | 10/2010 | Hodel |
| 2010/0276512 | A1 | 11/2010 | Nies |
| 2010/0301135 | A1 | 12/2010 | Hunnicutt et al. |
| 2010/0301142 | A1 | 12/2010 | Hunnicutt et al. |
| 2011/0024522 | A1 | 2/2011 | Anuskiewicz |
| 2011/0024526 | A1 | 2/2011 | Feith |
| 2011/0089250 | A1 | 4/2011 | Zhao et al. |
| 2011/0121097 | A1 | 5/2011 | Walker |
| 2011/0248093 | A1 | 10/2011 | Kim |
| 2011/0248094 | A1 | 10/2011 | Robertson |
| 2011/0248097 | A1 | 10/2011 | Kim |
| 2011/0309161 | A1 | 12/2011 | Renquist |
| 2012/0012670 | A1 | 1/2012 | Kah, Jr. et al. |
| 2012/0061489 | A1 | 3/2012 | Hunnicutt et al. |
| 2012/0153051 | A1 | 6/2012 | Kah, Jr. et al. |
| 2012/0292403 | A1 | 11/2012 | Hunnicutt et al. |
| 2013/0334332 | A1 | 12/2013 | Robertson et al. |
| 2013/0334340 | A1 | 12/2013 | Walker et al. |
| 2014/0027527 | A1 | 1/2014 | Walker |

FOREIGN PATENT DOCUMENTS

| | | |
|---|---|---|
| CN | 2794646 | 7/2006 |
| CN | 2805823 | 8/2006 |
| DE | 1283591 B | 11/1968 |
| DE | 3335805 | 2/1985 |
| EP | 463742 | 1/1992 |
| EP | 489679 | 6/1992 |
| EP | 518579 | 12/1992 |
| EP | 572747 | 12/1993 |
| EP | 646417 | 4/1995 |
| EP | 0724913 | 7/1996 |
| EP | 0761312 | 12/1997 |
| EP | 1016463 | 7/2000 |
| EP | 1043077 | 10/2000 |
| EP | 1173286 | 1/2002 |
| EP | 1250958 | 10/2002 |
| EP | 1270082 | 1/2003 |
| EP | 1289673 | 3/2003 |
| EP | 1426112 | 6/2004 |
| EP | 1440735 | 7/2004 |
| EP | 1452234 | 9/2004 |
| EP | 1502660 | 2/2005 |
| EP | 1508378 | 2/2005 |
| EP | 1043075 | 11/2005 |
| EP | 1818104 | 8/2007 |
| EP | 1944090 | 7/2008 |
| EP | 2251090 | 11/2010 |
| EP | 2255884 | 12/2010 |
| GB | 1234723 | 6/1971 |
| GB | 2330783 | 5/1999 |
| WO | 9520988 | 8/1995 |
| WO | 9727951 | 8/1997 |
| WO | 9735668 | 10/1997 |
| WO | 0007428 | 12/2000 |
| WO | 0131996 | 5/2001 |
| WO | 0162395 | 8/2001 |
| WO | 02078857 | 10/2002 |
| WO | 02098570 | 12/2002 |
| WO | 03086643 | 10/2003 |
| WO | 2004052721 | 6/2004 |
| WO | 2005099905 | 10/2005 |
| WO | 2005115554 | 12/2005 |
| WO | 2005123263 | 12/2005 |
| WO | 2006108298 | 10/2006 |
| WO | 2007131270 | 11/2007 |
| WO | 2008130393 | 10/2008 |
| WO | 2009036382 | 3/2009 |
| WO | 2010036241 | 4/2010 |
| WO | 2010126769 | 11/2010 |
| WO | 2011075690 | 6/2011 |

OTHER PUBLICATIONS

USPTO Office Action in U.S. Appl. No. 13/300,946, Mailed Oct. 12, 2012.
USPTO Office Action in U.S. Appl. No. 13/562,825, Mailed Oct. 15, 2012.
U.S. Appl. No. 12/248,644, filed Oct. 9, 2008.
U.S. Appl. No. 13/300,946, filed Nov. 21, 2011.
U.S. Appl. No. 12/475,242, filed May 29, 2009.
U.S. Appl. No. 12/720,261, filed Mar. 9, 2010.
U.S. Appl. No. 12/952,369, filed Nov. 23, 2010.
U.S. Appl. No. 13/495,402, filed Jun. 13, 2012.
U.S. Appl. No. 13/562,825, filed Jul. 31, 2012.
U.S. Appl. No. 13/828,582, filed Mar. 14, 2013.
U.S. Appl. No. 61/681,798, filed Aug. 10, 2012.
U.S. Appl. No. 61/681,802, filed Aug. 10, 2012.
Aug. 5, 2010 EPO Search Report and Opinion, EPO Application No. 10164085.2.
Mar. 29, 2011 Office Action, U.S. Appl. No. 12/475,242.
Advisory Action mailed Jul. 14, 2011 in U.S. Appl. No. 11/947,571.
Interview Summary mailed Sep. 26, 2011 in U.S. Appl. No. 12/475,242.
Office Action mailed Apr. 5, 2011 in U.S. Appl. No. 11/947,571.
Office Action mailed Jul. 20, 2011 in U.S. Appl. No. 12/475,242.
Office Action mailed Aug. 24, 2010 in U.S. Appl. No. 11/947,571.
Response to Office Action filed Apr. 29, 2011 in U.S. Appl. No. 12/475,242.
Response to Office Action filed Jul. 5, 2011 in U.S. Appl. No. 11/947,571.
Response to Office Action filed Oct. 18, 2011 in U.S. Appl. No. 12/475,242.
Response to Office Action filed Nov. 24, 2010 in U.S. Appl. No. 11/947,571.
Office action dated Sep. 3, 2013 for U.S. Appl. No. 13/300,946.
Office Action for U.S. Appl. No. 13/562,825, mailed on Oct. 15, 2012.
U.S. Appl. No. 13/560,423, filed Jul. 27, 2012.
U.S. Appl. No. 12/686,895, filed Jan. 13, 2010.
United States Patent and Trademark Office, Dec. 4, 2012 Office Action in U.S. Appl. No. 12/686,895.
United States Patent and Trademark Office, Apr. 10, 2013 Office Action in U.S. Appl. No. 13/562,825.
United States Patent and Trademark Office, May 24, 2013 Office Action in U.S. Appl. No. 12/720,261.
Jan. 5, 2011 Office Action, U.S. Appl. No. 12/248,644.
Sep. 30, 2010 Office Action, U.S. Appl. No. 12/248,644.
Jun. 25, 2012 Response to Office Action, U.S. Appl. No. 13/300,946.
Office Action for U.S. Appl. No. 13/300,946, mailed on Jun. 7, 2012.
Office Action for U.S. Appl. No. 13/300,946, mailed on Oct. 12, 2012.
U.S. Appl. No. 12/757,912, filed Apr. 19, 2010.

(56) References Cited

OTHER PUBLICATIONS

U.S. Appl. No. 12/859,159, filed Aug. 18, 2010.
U.S. Appl. No. 13/069,334, filed Mar. 22, 2011.
U.S. Appl. No. 13/523,846, filed Jun. 14, 2012.
European Search Report with European Search Opinion from the European Patent Office for Application No. 13171629.2 dated Jan. 22, 2015.
USPTO Non-Final Office Action dated Apr. 25, 2012 for U.S. Appl. No. 12/757,912 (17 pgs.).
Response dated Jul. 25, 2012 to Non-Final Office Action Apr. 25, 2012 for U.S. Appl. No. 12/757,912 (27 pgs.).
USPTO Final Rejection dated Oct. 23, 2012 for U.S. Appl. No. 12/757,912 (19 pgs.).
Response dated Mar. 25, 2013 to Final Rejection dated Oct. 23, 2012 for U.S. Appl. No. 12/757,912.
USPTO Applicant-Initiated Interview Summary dated Apr. 23, 2013 for U.S. Appl. No. 12/757,912 (3 pgs.).
Response dated Feb. 10, 2014 to Office Action mailed Jan. 10, 2014 for U.S. Appl. No. 13/069,334 (3 pgs.).
Written Opinion of the International Searching Authority and International Search Report issued in International Patent Application No. PCT/US10/61132 on Apr. 19, 2011.
Non-Final Office Action mailed Jun. 5, 2013 for U.S. Appl. No. 12/972,271 (8 pgs.).
Response dated Sep. 16, 2013 to Office Action mailed Jun. 5, 2013 for U.S. Appl. No. 12/972,271 (15 pgs.).
Final Office Action mailed Dec. 5, 2013 for U.S. Appl. No. 12/972,271 (9 pgs.).
Applicant-Initiated Interview Summary and Final Office Action mailed Mar. 5, 2014 for U.S. Appl. No. 12/972,271 (12 pgs.).
Non-Final Office Action dated Jan. 10, 2014 for U.S. Appl. No. 13/069,334 (6 pgs.).
Non-Final Office Action mailed Jan. 22, 2015 for U.S. Appl. No. 13/828,582.
Non-Final Office Action mailed Dec. 16, 2014 for U.S. Appl. No. 13/560,423.
Response dated Apr. 10, 2015 to Office Action mailed Dec. 16, 2014 for U.S. Appl. No. 13/560,423 (21 pgs).
Response dated Apr. 22, 2015 to Non-Final Office Action dated Apr. 22, 2015 for U.S. Appl. No. 13/828,582 (19 pgs).

* cited by examiner

ROTARY VARIABLE ARC NOZZLE

FIELD

This invention relates to irrigation sprinklers and, more particularly, to an irrigation sprinkler head or nozzle operative through an adjustable arc and with an adjustable flow rate.

BACKGROUND

Nozzles are commonly used for the irrigation of landscape and vegetation. In a typical irrigation system, various types of nozzles are used to distribute water over a desired area, including rotating stream type and fixed spray pattern type nozzles. One type of irrigation nozzle is the rotating deflector or so-called micro-stream type having a rotatable vaned deflector for producing a plurality of relatively small water streams swept over a surrounding terrain area to irrigate adjacent vegetation.

Rotating stream nozzles of the type having a rotatable vaned deflector for producing a plurality of relatively small outwardly projected water streams are known in the art. In such nozzles, one or more jets of water are generally directed upwardly against a rotatable deflector having a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range of throw depending on the radius reduction of water through the nozzle, among other things.

In rotating stream nozzles and in other nozzles, it is desirable to control the arcuate area through which the nozzle distributes water. In this regard, it is desirable to use a nozzle that distributes water through a variable pattern, such as a full circle, half-circle, or some other arc portion of a circle, at the discretion of the user. Traditional variable arc nozzles suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional nozzles have a fixed, dedicated construction that permits only a discrete number of arc patterns and prevents them from being adjusted to any arc pattern desired by the user.

Other conventional nozzle types allow a variable arc of coverage but only for a very limited arcuate range. Because of the limited adjustability of the water distribution arc, use of such conventional nozzles may result in overwatering or underwatering of surrounding terrain. This is especially true where multiple nozzles are used in a predetermined pattern to provide irrigation coverage over extended terrain. In such instances, given the limited flexibility in the types of water distribution arcs available, the use of multiple conventional nozzles often results in an overlap in the water distribution arcs or in insufficient coverage. Thus, certain portions of the terrain are overwatered, while other portions are not watered at all. Accordingly, there is a need for a variable arc nozzle that allows a user to set the water distribution arc along a substantial continuum of arcuate coverage, rather than several models that provide a limited arcuate range of coverage.

It is also desirable to control or regulate the throw radius of the water distributed to the surrounding terrain. In this regard, in the absence of a radius reduction device, the irrigation nozzle will have limited variability in the throw radius of water distributed from the nozzle, given relatively constant water pressure from a source. The inability to adjust the throw radius results both in the wasteful watering of terrain that does not require irrigation or insufficient watering of terrain that does require irrigation. A radius reduction device is desired to allow flexibility in water distribution and to allow control over the distance water is distributed from the nozzle, without varying the water pressure from the source. Some designs provide only limited adjustability and, therefore, allow only a limited range over which water may be distributed by the nozzle.

In addition, in previous designs, adjustment of the distribution arc has been regulated through the use of a hand tool, such as a screwdriver. The hand tool may be used to access a slot in the top of the nozzle cap, which is rotated to increase or decrease the length of the distribution arc. The slot is generally at one end of a shaft that rotates and causes an arc adjustment valve to open or close a desired amount. Users, however, may not have a hand tool readily available when they desire to make such adjustments. It would be therefore desirable to allow arc adjustment from the top of the nozzle without the need of a hand tool. It would also be desirable to allow the user to depress and rotate the top of the nozzle to directly actuate the arc adjustment valve, rather than through an intermediate rotating shaft.

Accordingly, a need exists for a truly variable arc nozzle that can be adjusted to a substantial range of water distribution arcs. In addition, a need exists to increase the adjustability of radius reduction and throw radius of an irrigation nozzle without varying the water pressure, particularly for rotating stream nozzles of the type for sweeping a plurality of relatively small water streams over a surrounding terrain area. Further, a need exists for a nozzle that allows a user to directly actuate an arc adjustment valve, rather than through a rotating shaft requiring a hand tool, and to adjust the throw radius by actuating or rotating an outer wall portion of the nozzle.

DESCRIPTION OF THE PREFERRED EMBODIMENT

Figure 1:
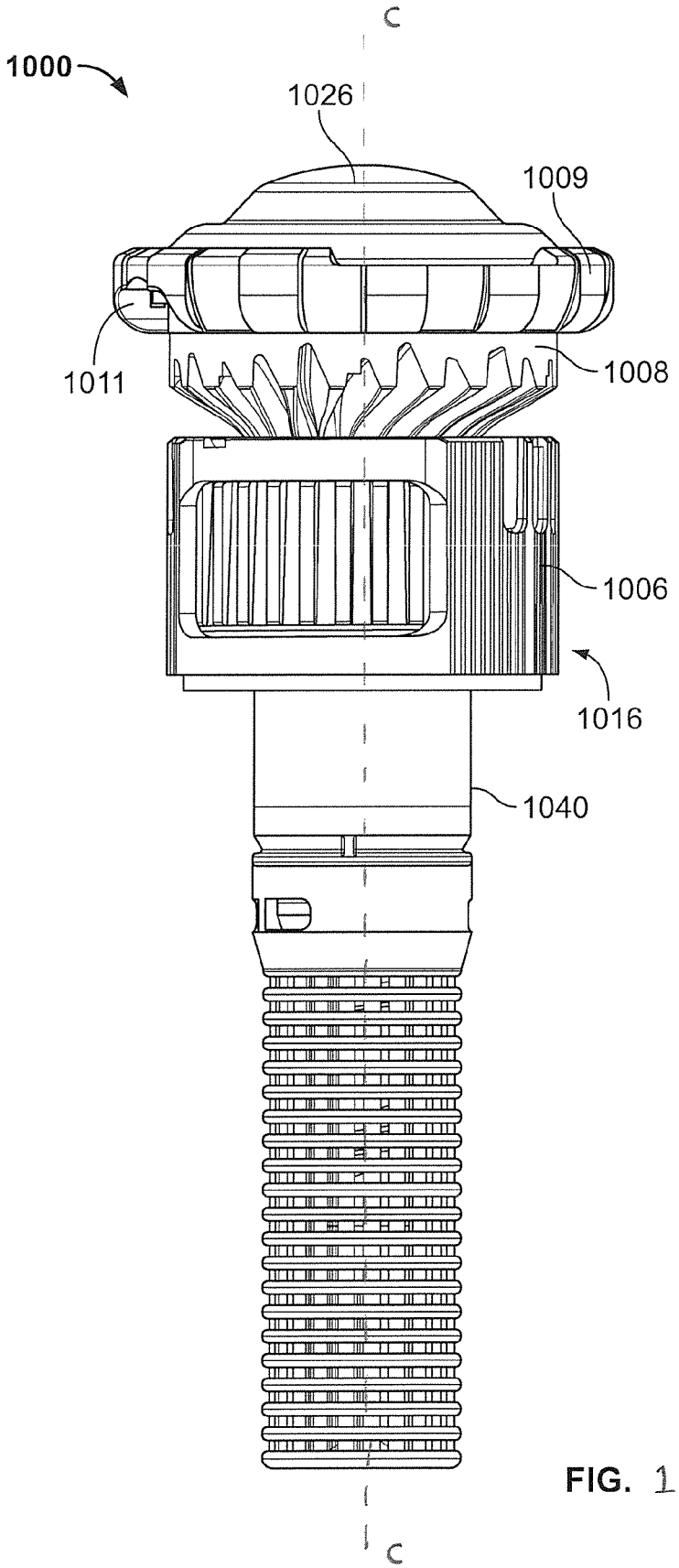
FIG. 1 is a perspective view of a preferred embodiment of a nozzle embodying features of the present invention.
Figure 2:
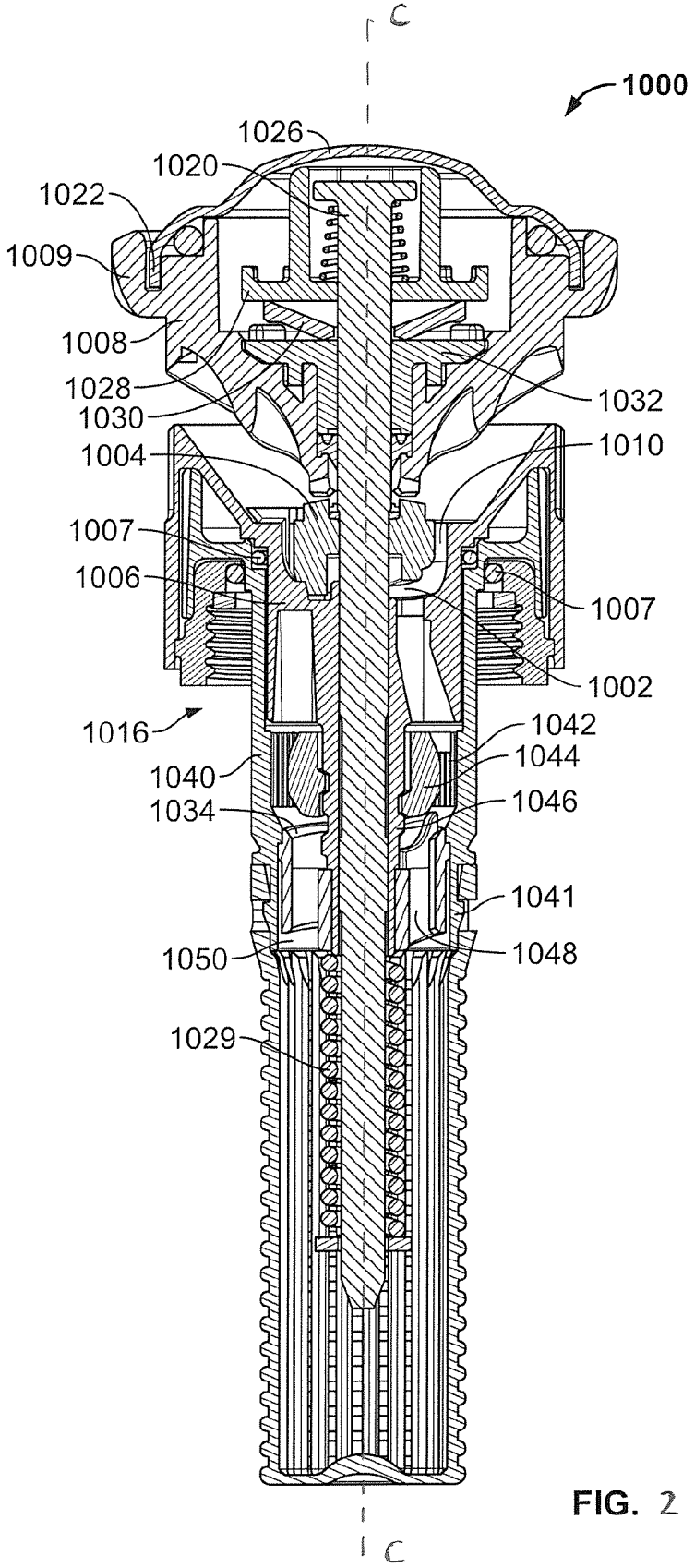
FIG. 2 is a cross-sectional view of the nozzle of FIG. 1.

FIGS. 1 and 2 show a preferred embodiment of the sprinkler head or nozzle 1000. The nozzle 1000 possesses an arc adjustability capability that allows a user to generally set the arc of water distribution to virtually any desired angle. The arc adjustment feature does not require a hand tool to access a slot at the top of the nozzle 1000 to rotate a shaft. Instead, the user may depress part or all of the deflector 1008 and rotate the deflector 1008 to directly set an arc adjustment valve 1002. The nozzle 1000 also preferably includes a flow rate adjustment feature (or radius reduction feature), which is shown in FIG. 2, to regulate flow rate and throw radius. The radius reduction feature is accessible by rotating an outer wall portion of the nozzle 1000, as described further below.

The arc adjustment and radius reduction features of the nozzle 1000 are similar to those described in U.S. patent application Ser. No. 12/952,369, which is assigned to the assignee of the present application and which application is incorporated herein by reference in its entirety. Further, some of the structural components of the nozzle 1000 are preferably similar to those described in U.S. patent application Ser. No. 12/952,369, and, as stated, the application is incorporated herein by reference in its entirety. Differences in the arc adjustment feature, radius reduction feature, and structural components are addressed below and with reference to the figures.

As described in more detail below, the nozzle 1000 allows a user to depress and rotate a deflector 1008 to directly actuate the arc adjustment valve 1002, i.e., to open and close the valve. The user depresses the deflector 1008 to directly engage and rotate one of the two nozzle body portions that forms the valve 1002 (valve sleeve 1004). The valve 1002 preferably operates through the use of two helical engagement surfaces that cam against one another to define an arcuate opening 1010. Although the nozzle 1000 preferably includes a shaft 1020, the user does not need to use a hand tool to effect rotation of the shaft 1020 to open and close the arc adjustment valve 1002. The shaft 1020 is not rotated to cause opening and closing of the valve 1002. Indeed, the shaft 1020 is preferably fixed against rotation, such as through use of splined engagement surfaces.

The nozzle 1000 also preferably uses a spring 1029 mounted to the shaft 1020 to energize and tighten the seal of the closed portion of the arc adjustment valve 1002. More specifically, the spring 1029 operates on the shaft 1020 to bias the first of the two nozzle body portions that forms the valve 1002 (valve sleeve 1004) downwardly against the second portion (nozzle cover 1006). In one preferred form, the shaft 1020 translates up and down a total distance corresponding to one helical pitch. The vertical position of the shaft 1020 depends on the orientation of the two helical engagement surfaces with respect to one another. By using a spring 1029 to maintain a forced engagement between valve sleeve 1004 and nozzle cover 1006, the nozzle 1000 provides a tight seal of the closed portion of the arc adjustment valve 1002, concentricity of the valve 1002, and a uniform jet of water directed through the valve 1002. In addition, mounting the spring 1029 at one end of the shaft 1020 results in a lower cost of assembly. Further, as described below, the spring 1029 also provides a tight seal of other portions of the nozzle body 1016, i.e., the nozzle cover 1006 and collar 1040.

As can be seen in FIGS. 1 and 2, the nozzle 1000 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 1016. The water preferably passes through an inlet 1050 controlled by an adjustable flow rate feature that regulates the amount of fluid flow through the nozzle body 1016. The water is then directed through an arcuate opening 1010 that determines the arcuate span of water distributed from the nozzle 1000. Water is directed generally upwardly through the arcuate opening 1010 to produce one or more upwardly directed water jets that impinge the underside surface of a deflector 1008 for rotatably driving the deflector 1008.

Figure 3:
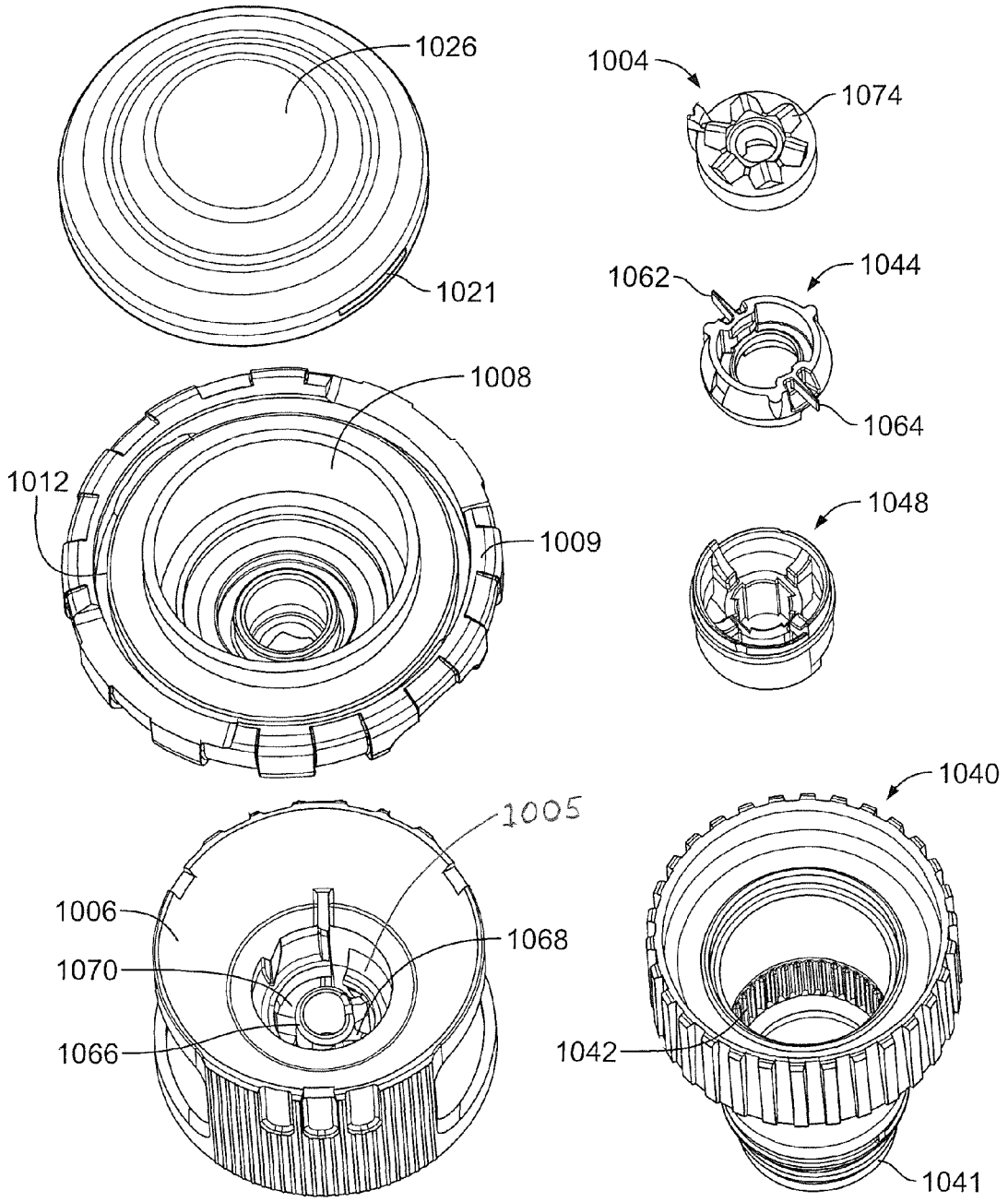
FIG. 3 is a top perspective view of the cap, deflector, nozzle cover, valve sleeve, throttle nut, valve seat, and nozzle collar of the nozzle of FIG. 1.
Figure 4:
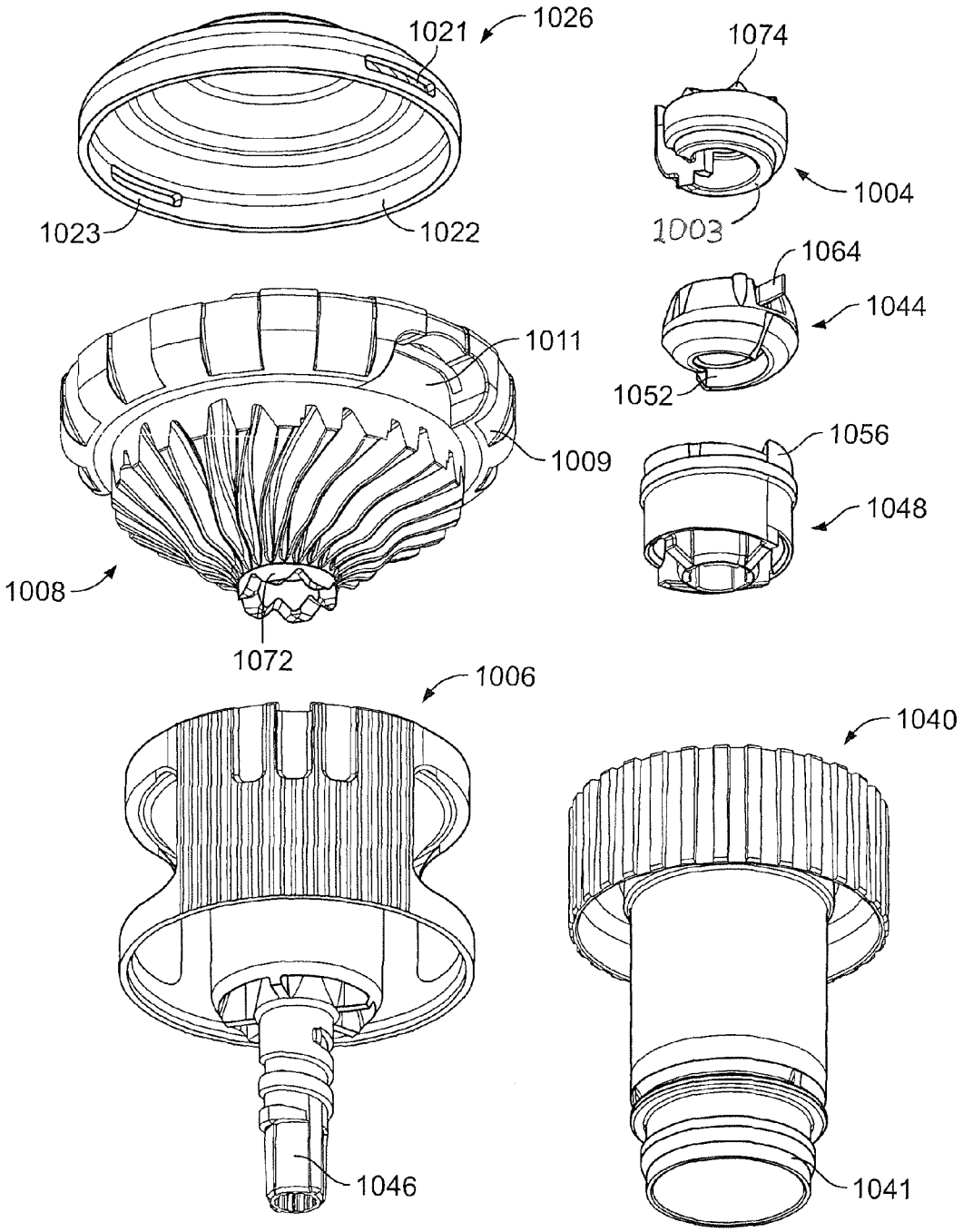
FIG. 4 is a bottom perspective view of the cap, deflector, nozzle cover, valve sleeve, throttle nut, valve seat, and nozzle collar of the nozzle of FIG. 1.

The rotatable deflector 1008 has an underside surface that is contoured to deliver a plurality of fluid streams generally radially outwardly therefrom through an arcuate span. As shown in FIG. 4, the underside surface of the deflector 1008 preferably includes an array of spiral vanes. The spiral vanes subdivide the water jet or jets into the plurality of relatively small water streams which are distributed radially outwardly therefrom to surrounding terrain as the deflector 1008 rotates. The vanes define a plurality of intervening flow channels extending upwardly and spiraling along the underside surface to extend generally radially outwardly with selected inclination angles. During operation of the nozzle 1000, the upwardly directed water jet or jets impinge upon the lower or upstream segments of these vanes, which subdivide the water flow into the plurality of relatively small flow streams for passage through the flow channels and radially outward projection from the nozzle 1000. A deflector like the type shown in U.S. Pat. No. 6,814,304, which is assigned to the assignee of the present application and is incorporated herein by reference in its entirety, is preferably used. Other types of deflectors, however, may also be used The variable arc capability of nozzle 1000 results from the interaction of two portions of the nozzle body 1016 (nozzle cover 1006 and valve sleeve 1004). More specifically, as can be seen in FIGS. 3 and 4, the nozzle cover 1006 and the valve sleeve 1004 have corresponding helical engagement surfaces. The valve sleeve 1004 may be rotatably adjusted with respect to the nozzle cover 1006 to close the arc adjustment valve 1002, i.e., to adjust the length of arcuate opening 1010, and this rotatable adjustment also results in upward or downward translation of the valve sleeve 1004. In turn, this camming action results in upward or downward translation of the shaft 1020 with the valve sleeve 1004. The arcuate opening 1010 may be adjusted to any desired water distribution arc by the user through push down and rotation of the deflector 1008.

As shown in FIGS. 2-4, the valve sleeve 1004 has a generally cylindrical shape. The valve sleeve 1004 includes a central hub defining a bore therethrough for insertion of the shaft 1020. The downward biasing force of spring 1029 against shaft 1020 results in a friction press fit between an inclined shoulder of the shaft 1020, a retaining washer, and a top surface of the valve sleeve 1004. The valve sleeve 1004 preferably has a top surface with teeth 1074 formed therein for engagement with the deflector teeth 1072. The valve sleeve 1004 also includes a bottom helical surface 1003 that engages and cams against a corresponding helical surface 1005 of the nozzle cover 1006 to form the arc adjustment valve 1002. As shown in FIG. 3, the non-rotating nozzle cover 1006 has an internal helical surface 1005 that defines approximately one 360 degree helical revolution, or pitch.

The arcuate span of the nozzle 1000 is determined by the relative positions of the internal helical surface 1005 of the nozzle cover 1006 and the complementary external helical surface 1003 of the valve sleeve 1004, which act together to form the arcuate opening 1010. The camming interaction of the valve sleeve 1004 with the nozzle cover 1006 forms the arcuate opening 1010, as shown in FIG. 2, where the arc is open on the right side of the C-C axis. The length of the arcuate opening 1010 is determined by push down and rotation of the deflector 1008 (which in turn rotates the valve sleeve 1004) relative to the non-rotating nozzle cover 1006. The valve sleeve 1004 may be rotated with respect to the nozzle cover 1006 along the complementary helical surfaces through approximately one helical pitch to raise or lower the valve sleeve 1004. The valve sleeve 1004 may be rotated through approximately one 360 degree helical pitch with respect to the nozzle cover 1006. The valve sleeve 1004 may be rotated relative to the nozzle cover 1006 to an arc desired by the user and is not limited to discrete arcs, such as quarter-circle and half-circle.

In an initial lowermost position, the valve sleeve 1004 is at the lowest point of the helical turn on the nozzle cover 1006 and completely obstructs the flow path through the arcuate opening 1010. As the valve sleeve 1004 is rotated in the clockwise direction, however, the complementary external helical surface 1003 of the valve sleeve 1004 begins to traverse the helical turn on the internal surface 1005 of the nozzle cover 1006. As it begins to traverse the helical turn, a portion of the valve sleeve 1004 is spaced from the nozzle cover 1006 and a gap, or arcuate opening 1010, begins to form between the valve sleeve 1004 and the nozzle cover 1006. This gap, or arcuate opening 1010, provides part of the flow path for water flowing through the nozzle 1000. The angle of the arcuate opening 1010 increases as the valve sleeve 1004 is further rotated clockwise and the valve sleeve 1004 continues to traverse the helical turn.

When the valve sleeve 1004 is rotated counterclockwise, the angle of the arcuate opening 1010 is decreased. The complementary external helical surface 1003 of the valve sleeve 1004 traverses the helical turn in the opposite direction until it reaches the bottom of the helical turn. When the surface 1003 of the valve sleeve 1004 has traversed the helical turn completely, the arcuate opening 1010 is closed and the flow path through the nozzle 1000 is completely or almost completely obstructed. It should be evident that the direction of rotation of the valve sleeve 1004 for either opening or closing the arcuate opening 1010 can be easily reversed, i.e., from clockwise to counterclockwise or vice versa, such as by changing the thread orientation.

As shown in FIG. 2, the nozzle 1000 also preferably includes a radius reduction valve 1034. The radius reduction valve 1034 can be used to selectively set the water flow rate through the nozzle 1000, for purposes of regulating the range of throw of the projected water streams. It is adapted for variable setting through use of a rotatable segment located on an outer wall portion of the nozzle 1000. It functions as a second valve that can be opened or closed to allow the flow of water through the nozzle 1000. Also, a filter is preferably located upstream of the radius reduction valve 1034, so that it obstructs passage of sizable particulate and other debris that could otherwise damage the sprinkler components or compromise desired efficacy of the nozzle 1000.

As shown in FIG. 2, the radius reduction valve structure preferably includes a nozzle collar 1040, a flow control member (preferably in the form of throttle nut 1044), and the nozzle cover 1006. The nozzle collar 1040 is rotatable about the central axis C-C of the nozzle 1000. It has an internal engagement surface 1042 and engages the throttle nut 1044 so that rotation of the nozzle collar 1040 results in rotation of the throttle nut 1044. The throttle nut 1044 also threadedly engages a post 1046 of the nozzle cover 1006 such that rotation of the throttle nut 1044 causes it to move in an axial direction, as described further below. In this manner, rotation of the nozzle collar 1040 can be used to move the throttle nut 1044 axially closer to and further away from an inlet 1050. When the throttle nut 1044 is moved closer to the inlet 1050, the flow rate is reduced. The axial movement of the throttle nut 1044 towards the inlet 1050 increasingly pinches the flow through the inlet 1050. When the throttle nut 1044 is moved further away from the inlet 1050, the flow rate is increased. This axial movement allows the user to adjust the effective throw radius of the nozzle 1000 without disruption of the streams dispersed by the deflector 1008.

As can be seen in FIGS. 2-4, the throttle nut 1044 is coupled to the nozzle cover 1006. More specifically, the throttle nut 1044 is internally threaded for engagement with an externally threaded hollow post 1046 at the lower end of the nozzle cover 1006. Rotation of the throttle nut 1044 causes it to move along the threading in an axial direction. In one preferred form, rotation of the throttle nut 1044 in a counterclockwise direction advances the nut 1044 towards the inlet 1050 and away from the deflector 1008. Conversely, rotation of the throttle nut 1044 in a clockwise direction causes it to move away from the inlet 1050. Although threaded surfaces are shown in the preferred embodiment, it is contemplated that other engagement surfaces could be used to effect axial movement.

In operation, a user may rotate the outer wall of the nozzle collar 1040 in a clockwise or counterclockwise direction. As shown in FIGS. 3 and 4, the nozzle cover 1006 preferably includes one or more cut-out portions to define one or more access windows to allow rotation of the nozzle collar outer wall. Further, as shown in FIG. 2, the nozzle collar 1040, throttle nut 1044, and nozzle cover 1006 are oriented and spaced to allow the throttle nut 1044 to essentially block fluid flow through the inlet 1050 or to allow a desired amount of fluid flow through the inlet 1050. As can be seen in FIG. 4, the throttle nut 1044 preferably has a helical bottom surface 1052 for engagement with a valve seat 1048 when fully extended.

Rotation in a counterclockwise direction results in axial movement of the throttle nut 1044 toward the inlet 1050. Continued rotation results in the throttle nut 1044 advancing to the valve seat 1048 formed at the inlet 1050 for blocking fluid flow. The dimensions of the radial tabs 1062 and 1064 of the throttle nut 1044 and the splined internal surface 132 of the nozzle collar 1040 are preferably selected to provide over-rotation protection. More specifically, the radial tabs 1062 and 1064 are sufficiently flexible such that they slip out of the splined recesses upon over-rotation. Once the inlet 1050 is blocked, further rotation of the nozzle collar 1040 causes slippage of the radial tabs 1062 and 1064, allowing the collar 1040 to continue to rotate without corresponding rotation of the throttle nut 1044, which might otherwise cause potential damage to sprinkler components.

Rotation in a clockwise direction causes the throttle nut 1044 to move axially away from the inlet 1050. Continued rotation allows an increasing amount of fluid flow through the inlet 1050, and the nozzle collar 1040 may be rotated to the desired amount of fluid flow. When the valve is open, fluid flows through the nozzle 1000 along the following flow path: through the inlet 1050, between the nozzle collar 1040 and the throttle nut 1044, between the ribs 1068 of the nozzle cover 1006, through the arcuate opening 1010 (if set to an angle greater than 0 degrees), upwardly along the upper cylindrical wall of the nozzle cover 1006, to the underside surface of the deflector 1008, and radially outwardly from the deflector

1008. As noted above, water flowing through the opening 1010 may not be adequate to impart sufficient force for desired rotation of the deflector 1008, when the opening 1010 is set at relatively low angles. It should be evident that the direction of rotation of the outer wall for axial movement of the throttle nut 1044 can be easily reversed, i.e., from clockwise to counterclockwise or vice versa.

As addressed above and shown in FIGS. 1 and 2, the nozzle 1000 includes a nozzle body 1016 having an inlet 1050 and an outlet for directing fluid against the deflector 1008 and causing the deflector 1008 to rotate. The arc adjustment valve 1002 preferably includes a valve sleeve 1004 that engages a corresponding nozzle cover 1006, and the user depresses the deflector 1008 and rotates it to directly set the arc adjustment valve 1002. More specifically, the user depresses the deflector 1008 to directly engage and rotate the valve sleeve 1004. The valve sleeve 1002 and the nozzle cover 1006 preferably have helical engagement surfaces that cam against one another to create and define an arcuate opening 1010.

In this preferred form, the structure of certain components has been tailored to reduce the variable effect of fluid pressure on the torque required to rotate the collar 1040 to actuate the flow rate adjustment valve (or radius reduction valve 1034). More specifically, as described in more detail below, the structure of the valve seat 1048, the nozzle cover 1006, and the nozzle collar 1040 allows a user to rotate the collar 1040 with an adjustment torque that is substantially independent of fluid pressure through the nozzle body 1016. The spring force is not directed axially against the nozzle collar 1040 but is instead directed axially against the nozzle cover 1006. Further, the frictional engagement between the nozzle collar 1040 and other components of the nozzle body 1016 has been reduced. Essentially, this structure reduces the torque required by the user to rotate the nozzle collar 1040 and to actuate the valve 1034, and in short, the valve 1034 is easier for a user to operate.

The radius reduction valve 1034 and certain components are shown in FIGS. 2-4. As described above, the radius reduction valve 1034 is used to selectively set the water flow rate through the nozzle 1000 for the purpose of regulating the range of throw of the projected water streams. The user sets the flow rate and throw radius through the use of an actuator (in the form of nozzle collar 1040) that is operatively coupled to a throttle nut 1044 that moves axially toward and away from a valve seat 1048. More specifically, the nozzle collar 1040 has an internal engagement surface 1042 to engage tabs 1062 and 1064 of the throttle nut 1044, so that rotation of the nozzle collar 1040 results in rotation of the throttle nut 1044. Rotation of the throttle nut 1044 causes it to move in an axial direction along the threaded post 1046. In this manner, rotation of the nozzle collar 1040 can be used to move the throttle nut 1044 axially closer to and further away from the valve seat 1048.

As shown in FIGS. 3 and 4, the radius reduction valve 1034 preferably includes helical portions 1052 and 1056 formed on each of the throttle nut 1044 and the valve seat 1048 for engagement with one another. The throttle nut 1044 preferably has two radially-extending tabs 1062 and 1064 for engagement with and rotation by the internal splined surface 1042 of the nozzle collar 1040. The throttle nut 1044 preferably includes an internally-threaded bore 1066 such that the throttle nut 1044 threadedly engages the externally-threaded post 1046 of the nozzle cover 1006 and moves axially along the post 1046.

It is desirable to have the torque required for rotation of the nozzle collar 1040 to be relatively constant regardless of the flow rate through the nozzle body 1016. More specifically, it is desirable that the nozzle collar 1040 not be more difficult to rotate at high flow rates and long radiuses of throw. Further, it is desirable that the torque be less than about 3 inches-pound so that a user can easily rotate the collar 1040 (and thereby operate the valve 1034) with his or her fingers.

In designs where a spring directly engages the collar and urges it in an upward direction, there may be friction between the rotating collar and the static, non-rotating spring. Further, depending on the arrangement of the nozzle collar and the nozzle cover, it has been found that upward axial flow of the water may cause the collar to be urged upwardly against the cover. In turn, this may cause increased frictional engagement between the collar and the cover, thereby requiring greater torque for rotation of the collar. Thus, fluid flowing upward through the nozzle adds torque resistance to the radius reduction mechanism. In fact, it has been found that the spring load directed against the collar may be responsible for about 30% of the required adjusting torque from a user (about 20% due to friction between the spring and collar and about 10% due to friction between the collar and cover).

With respect to nozzle 1000, the valve seat 1048, the nozzle cover 1006, and the nozzle collar 1040 reduce the variable effect of fluid pressure on the required adjusting torque. More specifically, the structure reduces or eliminates engagement and the resulting friction between spring 1029 and collar 1040 and between collar 1040 and cover 1006. By reducing or eliminating this engagement, the required adjusting torque does not fluctuate depending on increases and decreases in fluid pressure, i.e., it is largely independent of fluid pressure.

As can be seen in FIGS. 2-4, the post 1046 of the nozzle cover 1006 has been extended downwardly so that it engages the spring 1029 directly (instead of having the collar 1040 engage the spring 1029). The spring 1029 therefore engages the tip of the nozzle cover 1006 and removes the load from the collar 1040, i.e., the spring 1029 and collar 1040 are operationally decoupled from one another. Further, the valve seat 1048 has been lengthened and surrounds the extended post 1046, and this lengthened portion replaces part of the nozzle collar structure. Thus, fluid flowing upwardly through the nozzle 1000 pushes generally axially against the helical seat 1048, instead of pushing axially against the collar 1040, thereby reducing the frictional engagement of collar 1040 against cover 1006. As can be seen in FIGS. 2 and 4, the bottom portion of the collar 1040 is essentially in the form of a thin, annular wall 1041 that is largely isolated from both the spring force and from the axial force resulting from the upward fluid flow. The collar 1040 is now outside the flow path of fluid flowing upward through the radius reduction valve 1034.

Thus, in this manner, the required adjustment torque is relatively constant and is reduced from what might otherwise be required, at high flow rates. In nozzle 1000, the required torque still needs to overcome friction arising from the compression at o-ring seals 1007 and needs to be sufficient to move the throttle nut 1044 axially. However, the torque generally does not need to overcome friction resulting from engagement of spring 1029 and collar 1040 and engagement of collar 1040 and cover 1006 (or, at least, this friction is significantly reduced and the corresponding adjustment torque is significantly reduced).

Nozzle 1000 also includes a frustoconical brake pad 1030. As can be seen in FIGS. 2 and 5-7, the brake pad 1030 is part of a brake disposed in the deflector 1008, which maintains the rotation of the deflector 1008 at a relatively constant speed irrespective of flow rate, fluid pressure, and temperature. The brake includes the brake pad 1030 sandwiched between a friction disk 1028 (above the brake pad 1000) and a seal retainer 1032 (below the brake pad 1032). The friction disk 1028 is held relatively stationary by the shaft 1020, while the seal retainer 1032 rotates with the deflector 1008. During operation of the nozzle 1000, the seal retainer 1032 is urged upwardly against the brake pad 1030, which results in a variable frictional resistance that maintains a relatively constant rotational speed of the deflector 1008 irrespective of the rate of fluid flow, fluid pressure, and/or operating temperature.

Figure 5:
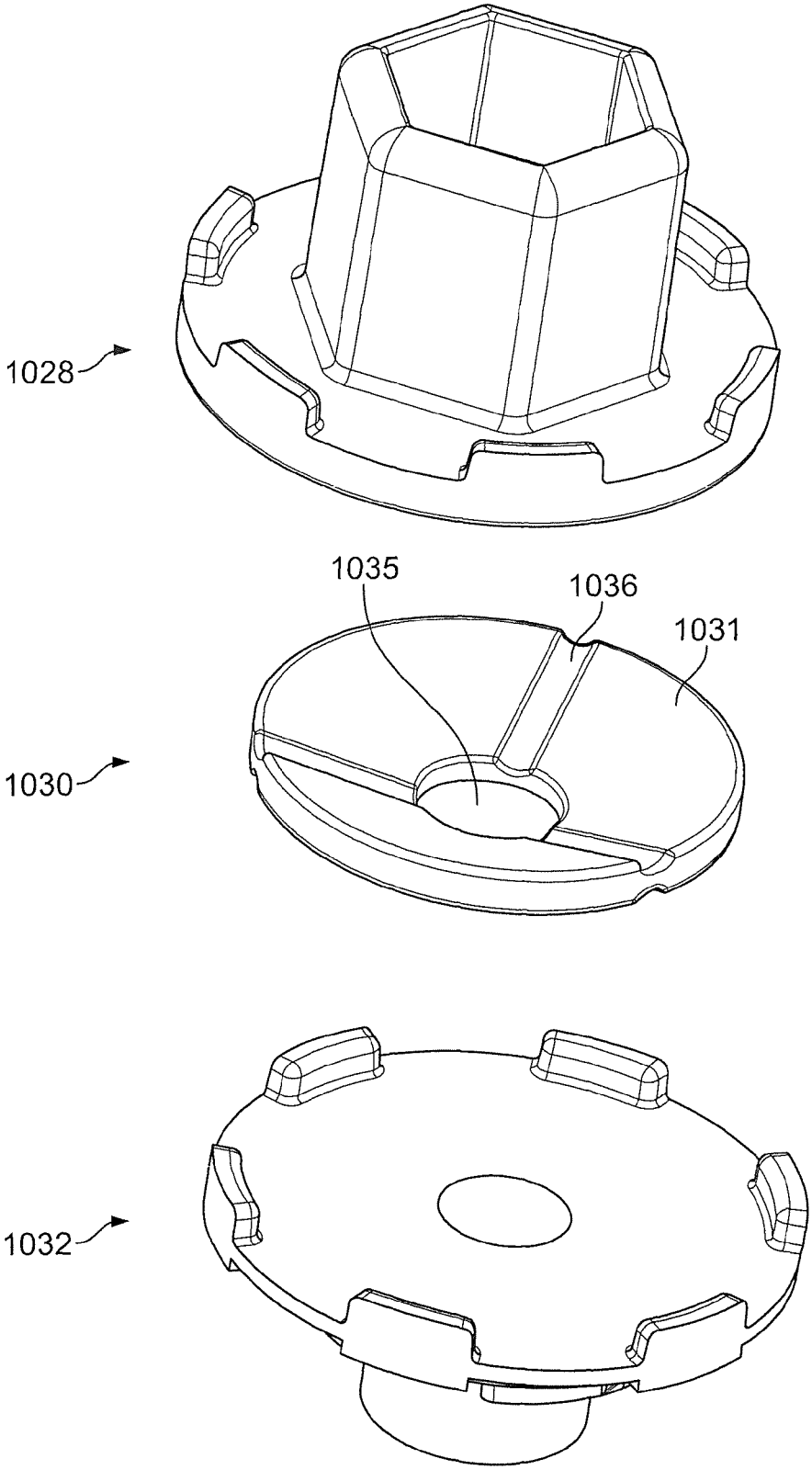
FIG. 5 is a top perspective view of the friction disk, brake pad, and seal retainer of the nozzle of FIG. 1.
Figure 6:
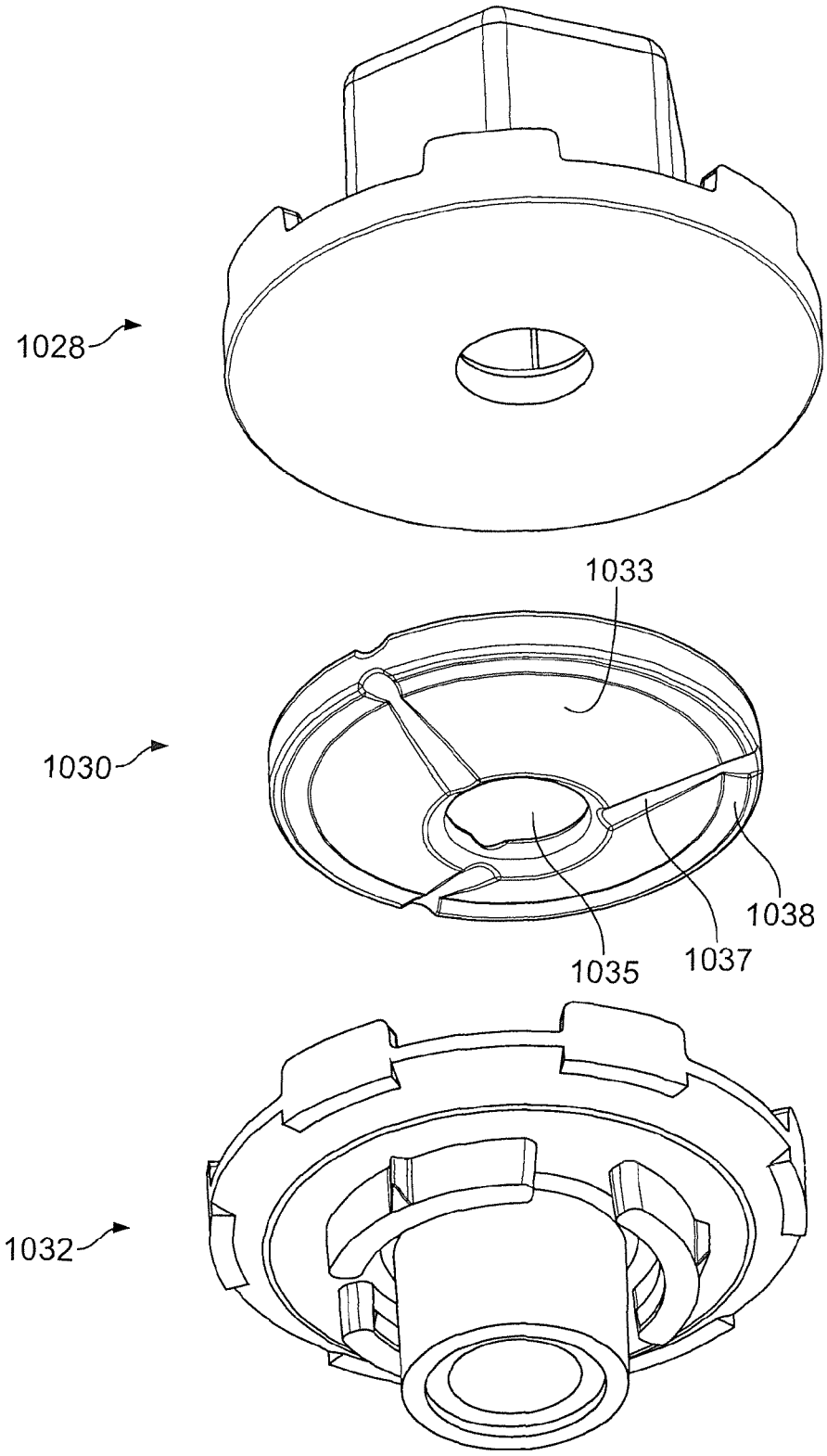
FIG. 6 is a bottom perspective view of the friction disk, brake pad, and seal retainer of the nozzle of FIG. 1.
Figure 7:
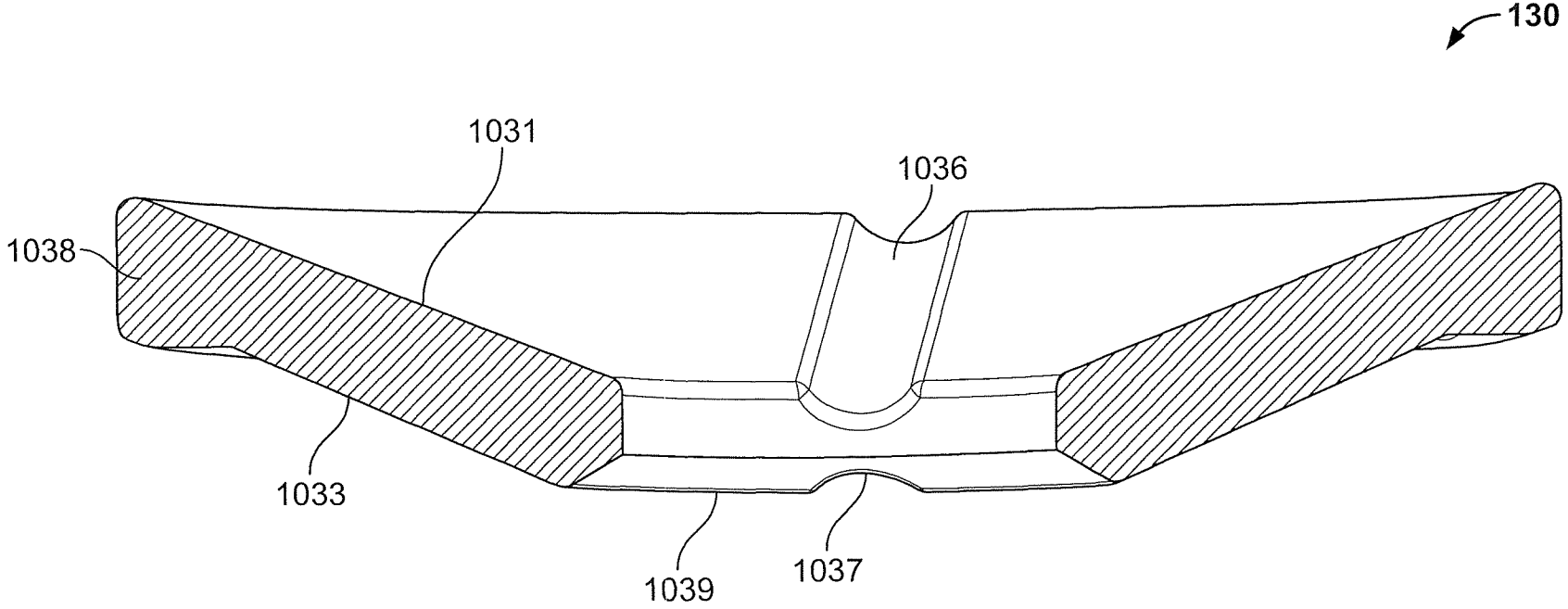
FIG. 7 is a cross-sectional view of the brake pad of the nozzle of FIG. 1.

As can be seen in FIGS. 5-7, the brake pad 1030 is generally frustoconical in shape and includes a top surface 1031 and a bottom surface 1033. The frustoconical shape is inverted as shown in the figures and includes a central bore 1035 for insertion of the shaft 1020. The top surface 1031 includes three radial grooves 1036 spaced equidistantly about the top surface 1031 and preferably having a uniform width. The bottom surface 1033 also includes three radial grooves 1037, but in contrast, these grooves 1037 do not have a uniform width. As can be seen, the grooves 1037 generally taper from a greater width at the bore 1035 to a lesser width as one proceeds radially outward towards the outer circumference of the brake pad 1030. Further, the bottom surface 1033 includes a horizontal lip 1038 at the outer circumference that is thicker in cross-section than the rest of the brake pad 1030. Also, instead of tapering, the width of the radial grooves 1037 increases as one proceeds radially outward along this horizontal lip 1038. The brake pad 1030 is preferably formed from a silicone rubber material and coated with a lubricant, such as a thin layer of a selected grease, to provide a relatively low coefficient of static friction. The grooves 1036 and 1037 facilitate retention of the lubricant.

In other brake designs, difficulties have been found in braking properly at low power input. The power input is determined generally by fluid pressure and/or flow rate and corresponds generally to the rotational force directed against the deflector by the impacting fluid. At low power input, where there is significant frictional engagement between the brake pad and other braking components, there has been too much braking, which may lead the nozzle to stall. For example, if the bottom surface of the brake pad 1030 has a horizontal portion as its bottommost surface, the brake pad 1030 will tend to cause too much friction at low power input. This issue is exacerbated at different operating temperatures because the lubricant viscosity changes at different temperatures, which results in too much friction at low power input at certain temperatures.

At low power input, the seal retainer 1032 is urged slightly upwardly against the bottom surface 1033 of the brake pad 1030. As can be seen in FIG. 7, in cross-section, the bottom surface 1033 has a narrow bottommost band of contact 1039, and the entire bottom surface 1033 defines a thin ring of contact (interrupted by the radial grooves 1037). Given low power input, the seal retainer 1032 only engages the brake pad 1030 at this relatively thin inner annular portion 1039 of the brake pad 1030. There may be some deformity of the brake pad 1030 that allows a slightly larger annular portion to engage the seal retainer 1032, but regardless, this frictional engagement provides relatively little braking at low power input. In contrast, a horizontal bottommost surface portion would result in significantly greater braking, which might result in stalling. Further, this thin ring of contact 1039 is less dependent on a lubricant, whose viscosity may change depending on temperature, which may result in variable friction (and braking) at low power input depending on temperature.

At high power input, the seal retainer 1032 is urged upwardly against the bottom surface 1033 of the brake pad 1030 such that the brake pad 1030 is substantially flattened. In this circumstance, the thick outermost annular lip 1038 is sandwiched between the friction disk 1028 and seal retainer 1032, and most of the friction (and braking) results from the engagement of the thick outer lip 1038 with the seal retainer 1032. This engagement results in significant braking at high power input. Accordingly, with relatively little braking at low power input and relatively significant braking at high power input, the brake provides a relatively constant deflector rotation speed, irrespective of flow rate, fluid pressure, and operating temperature.

Further, with respect to nozzle 1000, a cap 1026 is provided (preferably composed of stainless steel or a similar material) to provide protection to the brake against mishandling, misuse, and environmental exposure. As can be seen in FIGS. 3 and 4, the cap 1026 preferably includes two slots 1021 disposed in the lower annular rim 1022 of the cap 1026, preferably spaced 180 degrees apart. These slots 1021 are disposed in the cap 1026 such that a thin circumferential wall 1023 of material is located directly below each slot 1021. As described below, these walls 1023 are used to attach the cap 1026 to the deflector 1008.

The deflector 1008 includes a protruding flange 1009 at the top of the deflector 1008. The flange 1009 includes two cut-outs 1111 disposed preferably 180 degrees apart and corresponding to the slots 1021 and walls 1023 of the cap 1026. The cap 1026 is inserted in a circular groove 1012 formed in the top of the deflector 1008 and disposed within the groove 1012 so as to position the cap walls 1023 within the deflector cut-outs 1011. The walls 1023 are then punched inward to deform them and to thereby lock the cap 1026 to the deflector 1008. The energy needed to attach the cap 1026 is much less than the energy needed to detach the cap 1026 from the deflector 1008, and this manner of attachment is a way of tamper-proofing the nozzle 1000. Further, if a vandal removes the cap 1026 and causes internal damage, this action could be seen from the condition of the cap 1026 and deflector 1008, and it would be evident that such internal damage was not related to the fabrication process.

Also, as should be evident, the shaft and rib structure may be adapted to increase concentricity of the shaft 1020 and to increase the flow rate through the nozzle body 1016. It has been found that, during operation, the shaft 1020 is exposed to side loads and torsion effects from fluid flow. The central hubs of the valve sleeve 1004 and nozzle cover 1006 must provide adequate support so the shaft 1020 keeps its alignment and concentricity. When the shaft 1020 is misaligned, the flow rate may be reduced considerably.

Figure 8:
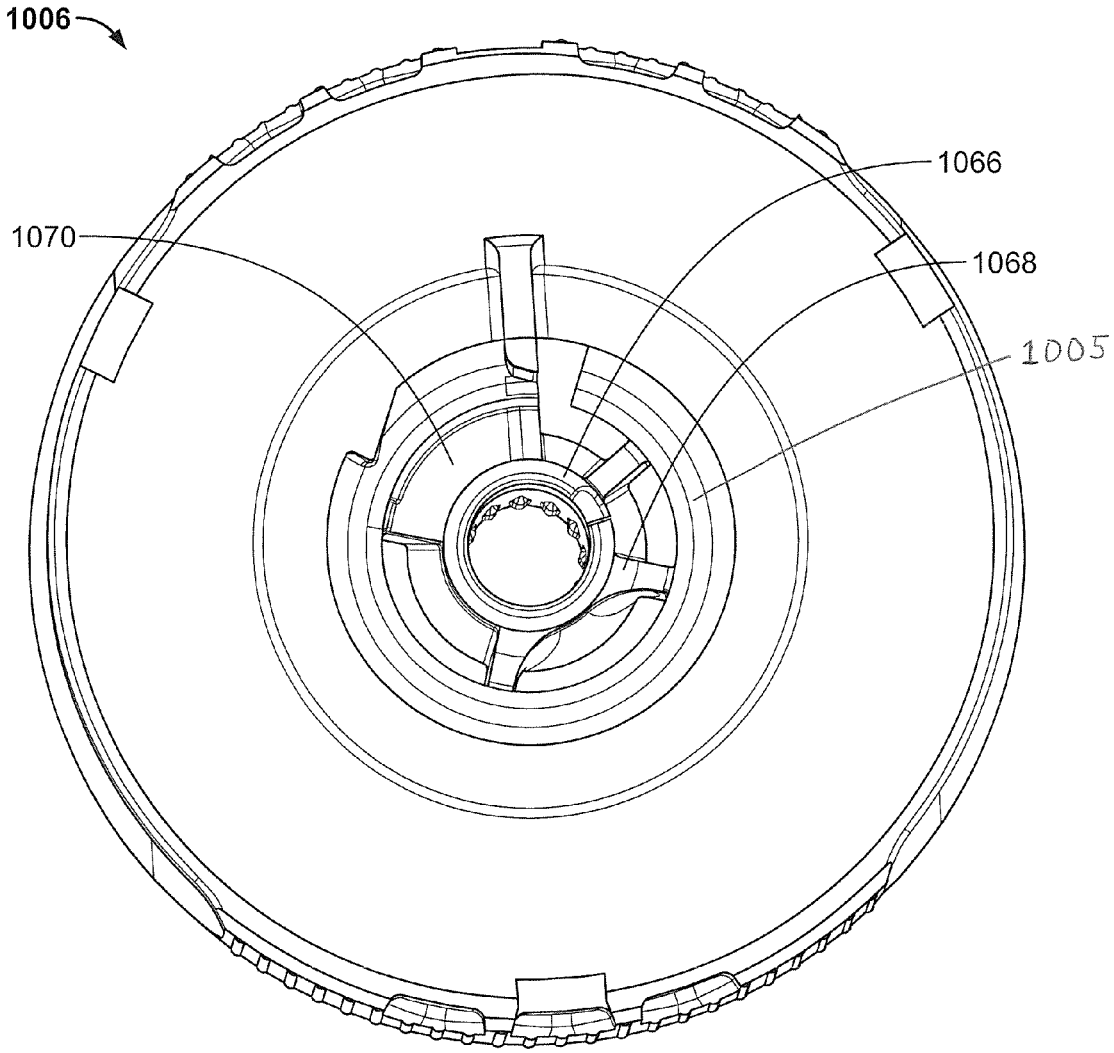
FIG. 8 is a top plan view of the nozzle cover of the nozzle of FIG. 1.
Figure 9:
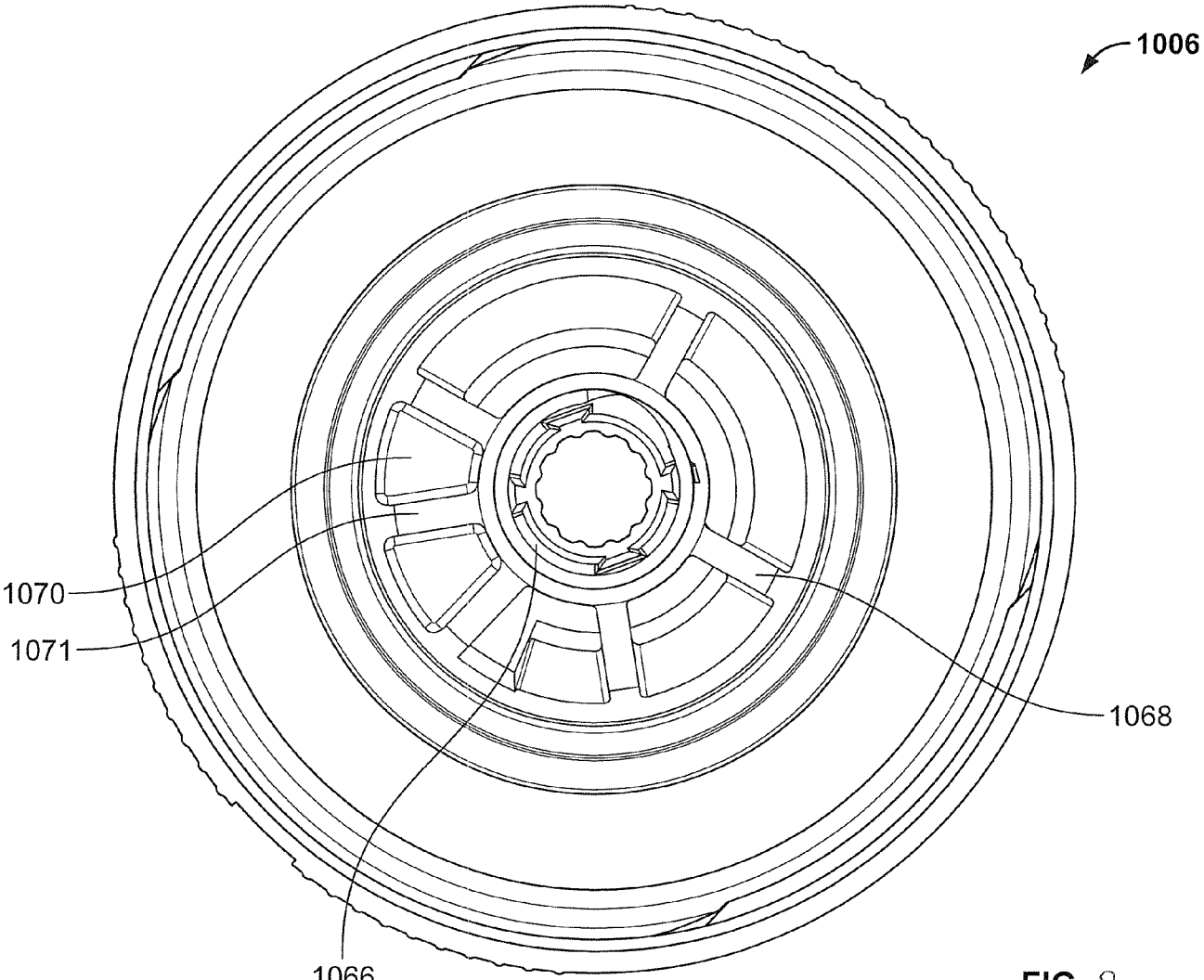
FIG. 9 is a bottom plan view of the nozzle cover of the nozzle of FIG. 1.

As shown in FIGS. 2, 8, and 9, nozzle 1000 has been tailored to increase concentricity and support of the shaft 1020 by: (1) increasing the engagement between the shaft 1020 and nozzle cover 1006 to distribute the load more evenly; and (2) thickening the central hub 1066 and ribs 1068 of the nozzle cover 1006 to reduce deformation. First, the engagement between shaft 1020 and nozzle cover 1006 has been increased by lengthening the outer surface of the shaft 1020 that engages and is supported by the central hub 1066 of the nozzle cover 1006 (FIG. 2). Second, the number of ribs 1068 in the flow path have been reduced and thickened, preferably to three thick ribs 1068 (FIG. 8), and the central hub 1066 of the nozzle cover 1006 has been thickened to provide support and allow a greater flow rate.

With respect to nozzle 1000, as shown in FIGS. 8 and 9, an arcuate wall 1070 is included in the nozzle cover 1006. More specifically, as can be seen in FIG. 3, the arcuate wall 1070 extends about 90 degrees about the central hub 1066 of the nozzle cover 1006. As a result, in this preferred form, the arc of water distribution is adjustable between about 0-degrees and 270 degrees. Of course, arcuate walls of different arcuate extent may also be used. However, there may not be sufficient fluid flow to impart sufficient force for rotation of the deflector 1008 at small arcs of distribution. This arcuate wall 1070 is preferably supported by three additional ribs 1071 (FIG. 9).

Figure 10:
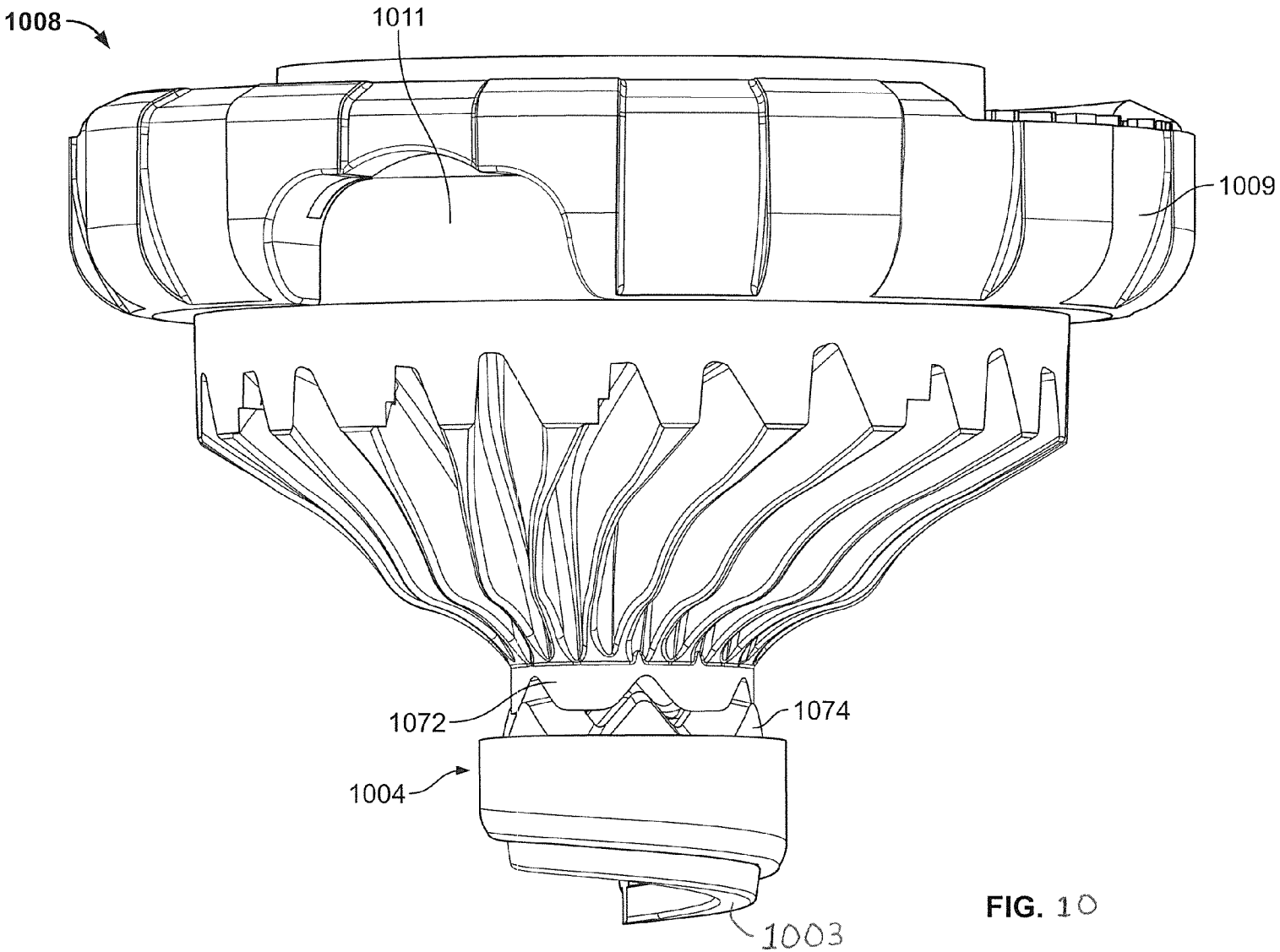
FIG. 10 is a side elevational view of the deflector and the valve sleeve of the nozzle of FIG. 1.

Also, with respect to nozzle 1000, the deflector 1008 and valve sleeve 1004 preferably include a relatively few number of teeth, and in this preferred form, they each include six teeth. As can be seen in FIG. 10, the downwardly-protruding deflector teeth 1072 are preferably truncated so as to be trapezoidal in cross-section. The truncated deflector teeth 1072 engage the top surface of the valve sleeve 1004. The use of teeth 1072 having this truncated shape provides more surface area for engagement of the two sets of teeth and requires less force for a user to rotate the deflector 1008 and valve sleeve 1004.

As can be seen in FIGS. 3 and 4, the valve sleeve 1004 includes six upwardly-projecting teeth 1074. The valve sleeve teeth 1074 are preferably not truncated so as to be triangular in cross-section. The valve sleeve teeth 1074 are received within corresponding triangular recesses of the deflector 1008. The slope of the triangular sides of the valve sleeve teeth 1074 is preferably selected so as to allow the deflector teeth 1072 and triangular teeth 1074 to slip past one another when a predetermined rotational torque is applied to rotate the deflector 1008. Of course, the orientation of teeth may be reversed with the valve sleeve teeth 1074 being truncated while the deflector teeth 1072 are not.

It will be understood that various changes in the details, materials, and arrangements of parts and components which have been herein described and illustrated in order to explain the nature of the sprinkler head may be made by those skilled in the art within the principle and scope of the sprinkler and the flow control device as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

a deflector having an underside surface contoured to deliver fluid radially outwardly therefrom;

a nozzle body having a central axis and defining an inlet, an outlet, a radius reduction valve, and an actuator for controlling the valve, the inlet capable of receiving fluid from a source, the outlet capable of delivering fluid to the underside surface of the deflector, and the radius reduction valve being adjustable to adjust the flow rate of fluid through the nozzle body;

an arc adjustment valve disposed downstream of the radius reduction valve, the arc adjustment valve being adjustable to change the length of an arcuate opening for the distribution of fluid from the deflector within a predetermined arcuate span; and a spring disposed upstream of both the radius reduction valve and the arc adjustment valve, the spring configured to bypass the radius reduction valve in biasing the arc adjustment valve;

wherein the actuator defines an outer surface of the nozzle body rotatable about the central axis to adjust the radius reduction valve with a torque independent of the flow rate through the nozzle body.

2. The nozzle of claim 1 wherein the arc adjustment valve comprises a first valve body and a second valve body each having helical surfaces for engagement with one another.

3. The nozzle of claim 2 wherein the nozzle body further comprises an arcuate wall blocking a portion of the fluid flow through the nozzle body such that the arc adjustment valve is adjustable within a predetermined range of adjustment.

4. The nozzle of claim 2 wherein the deflector is moveable axially to engage and rotate the first valve body, one of the deflector and the first valve body having truncated teeth for engagement with teeth of the other of the deflector and first valve body.

5. The nozzle of claim 2 wherein the spring is biased to urge at least a portion of the first valve body and at least a portion of the second valve body axially into engagement with one another and wherein the actuator is operatively decoupled from the spring.

6. The nozzle of claim 5 wherein the actuator is substantially free from friction resulting directly from the spring.

7. The nozzle of claim 6 wherein the actuator engages at least one o-ring during rotation of the actuator.

8. The nozzle of claim 1 further comprising a flow path from the inlet through the radius reduction valve to the outlet and wherein the actuator is outside the flow path.

9. The nozzle of claim 1 further comprising a brake for reducing the rotational speed of the deflector, the brake comprising a first body that rotates with the deflector, a second body that is fixed against rotation, and a brake pad disposed axially between the first body and the second body.

10. The nozzle of claim 9 wherein the brake pad is frustoconical in shape.

11. The nozzle of claim 1 wherein the radius reduction valve comprises a valve member operatively coupled to the rotatable actuator wherein rotation of the actuator causes the valve member to move axially toward or away from a valve seat.

12. The nozzle of claim 11 wherein the valve member is an internally threaded nut mounted for axial movement along external threading and wherein the actuator has a splined surface for engagement with the valve member.

13. The nozzle of claim 1 further comprising a cap having slots defining strips and wherein the deflector has cut-outs corresponding to the strips, the cap fastened to the deflector by moving the strips into engagement with the deflector.

14. A nozzle comprising:

a rotatable deflector having an underside surface contoured to deliver fluid radially outwardly therefrom;

a nozzle body defining an inlet and an outlet, the inlet capable of receiving fluid from a source and the outlet capable of delivering fluid to the underside surface of the deflector to cause rotation of the deflector; and a brake disposed within the deflector for maintaining rotation of the deflector at a relatively constant speed regardless of flow rate through the nozzle body and regardless of temperature;

wherein the brake comprises a first body that rotates with the deflector, a second body that is fixed against rotation, and a brake pad disposed between the first body and the second body;

wherein the brake pad defines a bore therethrough, has a bottommost surface defining an inner ring for engagement with the first body to reduce deflector rotation at low power input, and has an outermost lip for engagement with the first body to reduce deflector rotation at high power input, the outermost lip being thicker than the remainder of the brake pad.

15. The nozzle of claim 14 wherein the brake pad is frustoconical in shape.

16. The nozzle of claim 14 wherein the brake pad has at least one radial groove for receiving a lubricant therein.

17. A nozzle comprising:

a rotatable deflector having an underside surface contoured to deliver fluid radially outwardly therefrom;

a radius reduction valve for adjusting the radius of throw of the nozzle with a constant adjustment torque independent of flow rate; and a flow path from an inlet through the radius reduction valve to the deflector and outwardly away from the deflector; and a brake mounted within the deflector for maintaining relatively constant rotational speed of the deflector independent of flow rate and temperature and including a brake pad;

wherein the brake pad is frustoconical in shape, defines a bore therethrough, has a bottommost surface defining an inner ring for engagement with a rotating body to reduce deflector rotation at low power input, and has an outermost lip for engagement with the rotating body to reduce deflector rotation at high power input, the outermost lip being thicker than the remainder of the brake pad.

18. The nozzle of claim 17 further comprising an actuator for adjusting the radius reduction valve between a minimum radius of throw and a maximum radius of throw, the actuator disposed outside of the flow path and confining fluid within the flow path.

* * * * *

UNITED STATES PATENT AND TRADEMARK OFFICE

CERTIFICATE OF CORRECTION

PATENT NO. : 9,079,202 B2
APPLICATION NO. : 13/495402
DATED : July 14, 2015
INVENTOR(S) : Samuel C. Walker, John Austin Brennan and Alberto Carrillo Maloof It is certified that error appears in the above-identified patent and that said Letters Patent is hereby corrected as shown below:

TITLE PAGE:

Column 1, item (75) Inventors, line 2, delete "Tuscon" and insert --Tucson-- therefor.

IN THE SPECIFICATION:

Column 4, line 36, after "used" insert --.--.

Column 9, line 1, delete "brake pad 1032" and insert --brake pad 1030-- therefor.

Column 9, line 34, delete "and/or" and insert --and-- therefor.

Signed and Sealed this
Twenty-ninth Day of December, 2015

Michelle K. Lee

Michelle K. Lee
*Director of the United States Patent and Trademark Office*